US009926176B2

(12) United States Patent
Kosuga

(10) Patent No.: US 9,926,176 B2
(45) Date of Patent: Mar. 27, 2018

(54) CHAIN BLOCK

(71) Applicant: KITO CORPORATION, Nakakoma-gun, Yamanashi (JP)

(72) Inventor: Kosuke Kosuga, Yamanashi (JP)

(73) Assignee: KITO CORPORATION, Nakakoma-Gun, Yamanashi (JP)

( * ) Notice: Subject to any disclaimer, the term of this patent is extended or adjusted under 35 U.S.C. 154(b) by 262 days.

(21) Appl. No.: 14/648,809

(22) PCT Filed: Nov. 26, 2013

(86) PCT No.: PCT/JP2013/081778
§ 371 (c)(1),
(2) Date: Jun. 1, 2015

(87) PCT Pub. No.: WO2014/084208
PCT Pub. Date: Jun. 5, 2014

(65) Prior Publication Data

US 2015/0298946 A1 Oct. 22, 2015

(30) Foreign Application Priority Data

Nov. 30, 2012 (JP) ..... 2012-262616

(51) Int. Cl.
*B66D 1/28* (2006.01)
*B66D 3/16* (2006.01)

(52) U.S. Cl.
CPC ..... *B66D 3/16* (2013.01)

(58) Field of Classification Search
CPC ... B66D 1/28; B66D 3/12; B66D 3/16; B66D 3/26; B66D 2700/0183; B66D 2700/02
See application file for complete search history.

(56) References Cited

U.S. PATENT DOCUMENTS 2,623,731 A * 12/1952 Kamlukin ..... B66D 3/16 254/345
3,894,720 A 7/1975 Koji
(Continued)

FOREIGN PATENT DOCUMENTS

CN 2154851 Y 2/1994
CN 2522405 Y 11/2002
(Continued)

OTHER PUBLICATIONS

International Search Report corresponding to Application No. PCT/JP2013/081778; dated Mar. 4, 2014.
(Continued)

*Primary Examiner* — Emmanuel M Marcelo
(74) *Attorney, Agent, or Firm* — Cantor Colburn LLP

(57) ABSTRACT

A chain block is provided including a first frame, a second frame, a wheel cover side structure including a wheel cover which covers the hand wheel and residing on an opposite side of the first frame in a direction away from the second frame, and a gear case side structure including a gear case covering a gear member and residing on an opposite side of the second frame in a direction away from the first frame, and each of the first frame and the second frame is provided with a rolling restriction portion restricting rolling along outer circumferences of the first frame and the second frame in a case of a standing posture in which the first frame and the second frame contact an installation part at the same time.

9 Claims, 24 Drawing Sheets

(56) References Cited

U.S. PATENT DOCUMENTS

| | | | | | |
|---|---|---|---|---|---|
| 5,544,863 | A * | 8/1996 | Ueno | B66D 3/16 | 254/358 |
| 5,586,752 | A * | 12/1996 | Wada | B66D 3/16 | 254/372 |
| 6,007,054 | A * | 12/1999 | Kobayasi | B66D 3/26 | 254/346 |
| 6,032,928 | A * | 3/2000 | Okamoto | B66D 3/16 | 254/372 |
| 6,062,543 | A * | 5/2000 | Kobayasi | B66D 3/16 | 254/372 |
| 7,614,610 | B2 * | 11/2009 | Xia | B66D 3/16 | 254/358 |
| 2002/0030182 | A1 | 3/2002 | Struck | | |
| 2013/0001489 | A1 | 1/2013 | Ishikawa | | |
| 2013/0270498 | A1 * | 10/2013 | Burneister | B66D 1/28 | 254/266 |

FOREIGN PATENT DOCUMENTS

| | | | |
|---|---|---|---|
| CN | 202492320 | U | 10/2012 |
| CN | 104428238 | A | 3/2015 |
| DE | 29921880 | A1 | 4/2001 |
| EP | 2881356 | A1 | 6/2015 |
| JP | 03223097 | A | 10/1991 |
| JP | 08259184 | A | 10/1996 |
| JP | H0940376 | A | 2/1997 |
| JP | H11139781 | A | 5/1999 |
| JP | 2001253691 | A | 9/2001 |
| JP | 2010116957 | A | 5/2010 |
| JP | 2011201637 | A | 10/2011 |

OTHER PUBLICATIONS

Extended European search report corresponding to Application No. 13857901.6-1705/2927180 PCT/JP2013/081778, dated Sep. 23, 2016.

Chinese Notification of the First Office Action corresponding to Patent No. 201380062137.3; dated Apr. 6, 2016, with English translation.

* cited by examiner

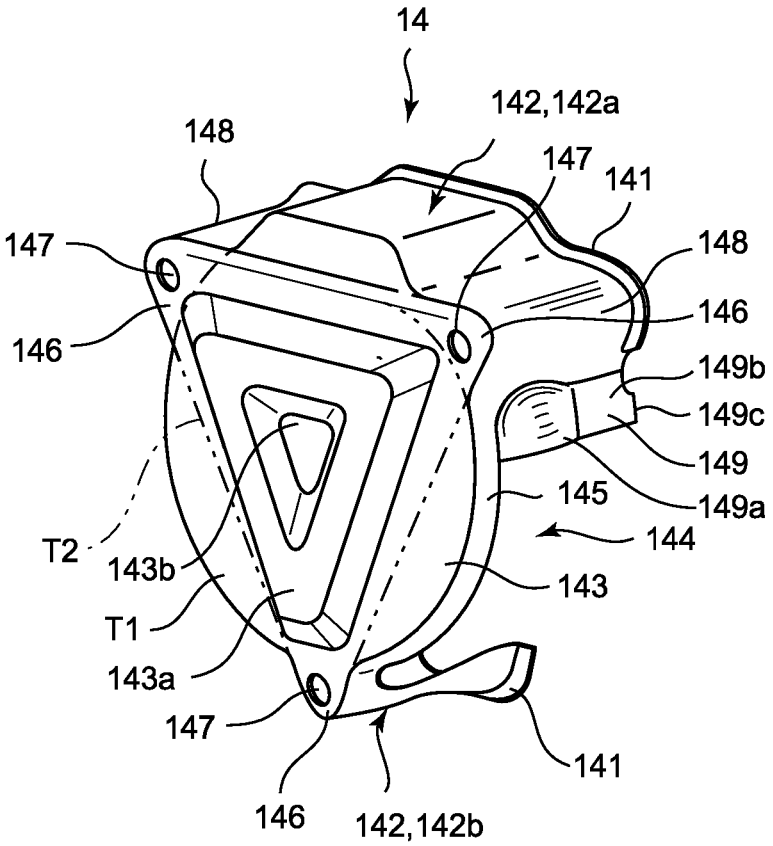
Fig.15
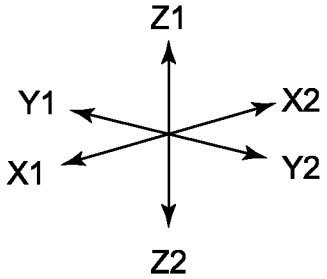

CHAIN BLOCK

This is the U.S. national stage of application No. PCT/JP2013/081778, filed on Nov. 26, 2013. Priority under 35 U.S.C. § 119(a) and 35 U.S.C. § 365(b) is claimed from Japanese Application No. 2012-262616, filed Nov. 30, 2012, the disclosure of which is also incorporated herein by reference.

TECHNICAL FIELD

The present invention relates to a chain block for use in a load hoisting work.

BACKGROUND ART

A chain block is used in general to move a load in an up-down direction. The chain block includes a hand wheel, a wheel cover, a main body portion, and the like. The main body portion is provided with a load sheave around which a load chain is wound. When a hand chain wound around the hand wheel is wound up, the hand wheel is rotated, and the rotation is transmitted via a predetermined transmission mechanism including gears and the like to the load sheave. Accordingly, the load hung on a lower hook moves in an upper direction. Conversely, when the hand chain is wound down in a state in which the load is located on an upper side, the load moves in a lower direction. An example of such a chain block is disclosed in Patent Literature 1.

In the chain block described in Patent Literature 1, a wheel cover (refer to FIG. 25) is attached to a second main frame and is provided in a shape conforming to arc-like outlines of a first main frame and the second main frame. Also, a gear cover (gear case) is provided to project from the first main frame so as to cover a gear part.

CITATION LIST

Patent Literature

{PTL 1}: JP 2011-201637 A

SUMMARY OF INVENTION

Technical Problem

When the chain block is moved or carried, the chain block is dragged in some cases. In general, such dragging is often performed with a load chain side gripped. When the chain block is dragged, the chain block rolls along the arc-like outlines of the first main frame and the second main frame even in a case in which the chain block is installed in an upright posture so that the two frames may contact the ground. In this case, the chain block is subject to impact from the ground and falls with the wheel cover or the gear case facing down, and the wheel cover or the gear case is dragged on the ground in this posture. This causes the following problem.

First, the case in which the chain block is dragged on the ground with the wheel cover facing down has a problem in which the dragging may cause tip end sides of stay bolts and nuts to be damaged, the nuts and the stay bolts to come off, and the wheel cover to come off. Second, the case in which the chain block is dragged on the ground with the gear case facing down has a problem in which the dragging may cause heads of rivets attaching a name plate to the gear case to be damaged and the rivets to come off. When the rivets come off in this manner, dust and the like will go into rivet holes of the gear case, which has an effect on mesh of gears.

The present invention is achieved based on the above circumstances, and an object thereof is to provide a chain block enabling to maintain a state in which side surfaces of a first frame and a second frame are dragged.

Solution to Problem

To solve the above problems, according to a first aspect of the present invention, a chain block is provided including a first frame rotatably supporting a load sheave member around which a load chain is wound and rotatably supporting a drive shaft which is rotated separately from the load sheave member, a second frame arranged to be opposed to the first frame and cooperating with the first frame to rotatably support the load sheave member and rotatably support the drive shaft, a wheel cover side structure including a hand wheel around which a hand chain is wound and a wheel cover which covers the hand wheel and residing on an opposite side of the first frame in a direction away from the second frame, and a gear case side structure including a plurality of gear members adapted to transmit a rotation force from the hand wheel via the drive shaft to the load sheave member and a gear case covering the gear member and residing on an opposite side of the second frame in a direction away from the first frame, and each of the first frame and the second frame is provided with a rolling restriction portion restricting rolling along outer circumferences of the first frame and the second frame in a case of a standing posture in which the first frame and the second frame contact an installation part at the same time.

Also, according to another aspect of the present invention, in the aforementioned invention, the rolling restriction portion is preferably configured to contact the installation part at a position spaced as much as a predetermined rolling prevention distance from an outer rim portion of each of the first frame and the second frame at the same time as the outer rim portion.

Further, according to another aspect of the present invention, in the aforementioned invention, a weight of the wheel cover side structure is preferably larger than a weight of the gear case side structure.

Still further, according to another aspect of the present invention, in the aforementioned invention, the gear case preferably includes a gear storage portion in which the gear members are stored, a height of the gear storage portion is preferably set, when the chain block is inclined with a side of the gear storage portion facing down in a state in which rolling of each of the first frame and the second frame is restricted by the rolling restriction portion, to prevent the chain block from being inclined further and prevent the chain block from falling with the gear storage portion facing down, and the gear storage portion preferably contacts the grounding part to cause the gear case to function as a falling prevention portion.

Still further, according to another aspect of the present invention, in the aforementioned invention, a height of the wheel cover is preferably set, when the chain block is inclined with a side of the wheel cover facing down in a state in which rolling of each of the first frame and the second frame is restricted by the rolling restriction portion, to prevent the chain block from being inclined further and prevent the chain block from falling with the wheel cover facing down, and the wheel cover preferably contacts the grounding part to cause the wheel cover to function as a falling prevention portion.

Still further, according to another aspect of the present invention, in the aforementioned invention, the first frame is preferably attached to the gear case in a state of projecting further to an outer circumferential side than the gear case, and the first frame preferably includes a circular portion having an arc-like outer rim portion and a frame projection portion projecting to an outer circumferential side from the circular portion and serving as the rolling restriction portion.

Still further, according to another aspect of the present invention, in the aforementioned invention, in a planar view of the first frame, the first frame is preferably provided with a stretching portion whose projecting amount of the outer rim portion of the first frame with respect to an outer rim portion of the gear case is larger than that of a side of the frame projection portion.

Still further, according to another aspect of the present invention, in the aforementioned invention, the second frame is preferably attached to the wheel cover in a state of projecting further to an outer circumferential side than the wheel cover, and the second frame preferably includes a circular portion having an arc-like outer rim portion and a frame projection portion projecting to an outer circumferential side from the circular portion and serving as the rolling restriction portion.

Still further, according to another aspect of the present invention, in the aforementioned invention, a position of a weighted center in the standing posture preferably resides in a lower position than a weighted center in a falling posture with the wheel cover facing down and a weighted center in a falling posture with the gear case facing down.

Advantageous Effects of Invention

According to the present invention, in a chain block, it is possible to maintain a state in which side surfaces of a first frame and a second frame are dragged.

BRIEF DESCRIPTION OF DRAWINGS

FIG. 7(A) illustrates the shape seen from a front side, and FIG. 7(B) illustrates the shape seen from a back side.

FIG. 10(A) illustrates the shape seen from a front side, and FIG. 10(B) illustrates the shape seen from a back side.

FIG. 11(A) is a perspective view seen from a front side, FIG. 11(B) is a perspective view seen from a back side, and FIG. 11(C) is a partially enlarged side cross-sectional view illustrating the shape around a flange portion.

FIG. 15 is a perspective view illustrating a shape of a wheel cover in the chain block in FIG. 1.

FIG. 17(A) illustrates a state in which the force acts on a side surface portion of a wheel cover having a conventional configuration, and FIG. 17(B) illustrates a state in which the force acts on a surrounding portion.

DESCRIPTION OF EMBODIMENTS

Figure 1:
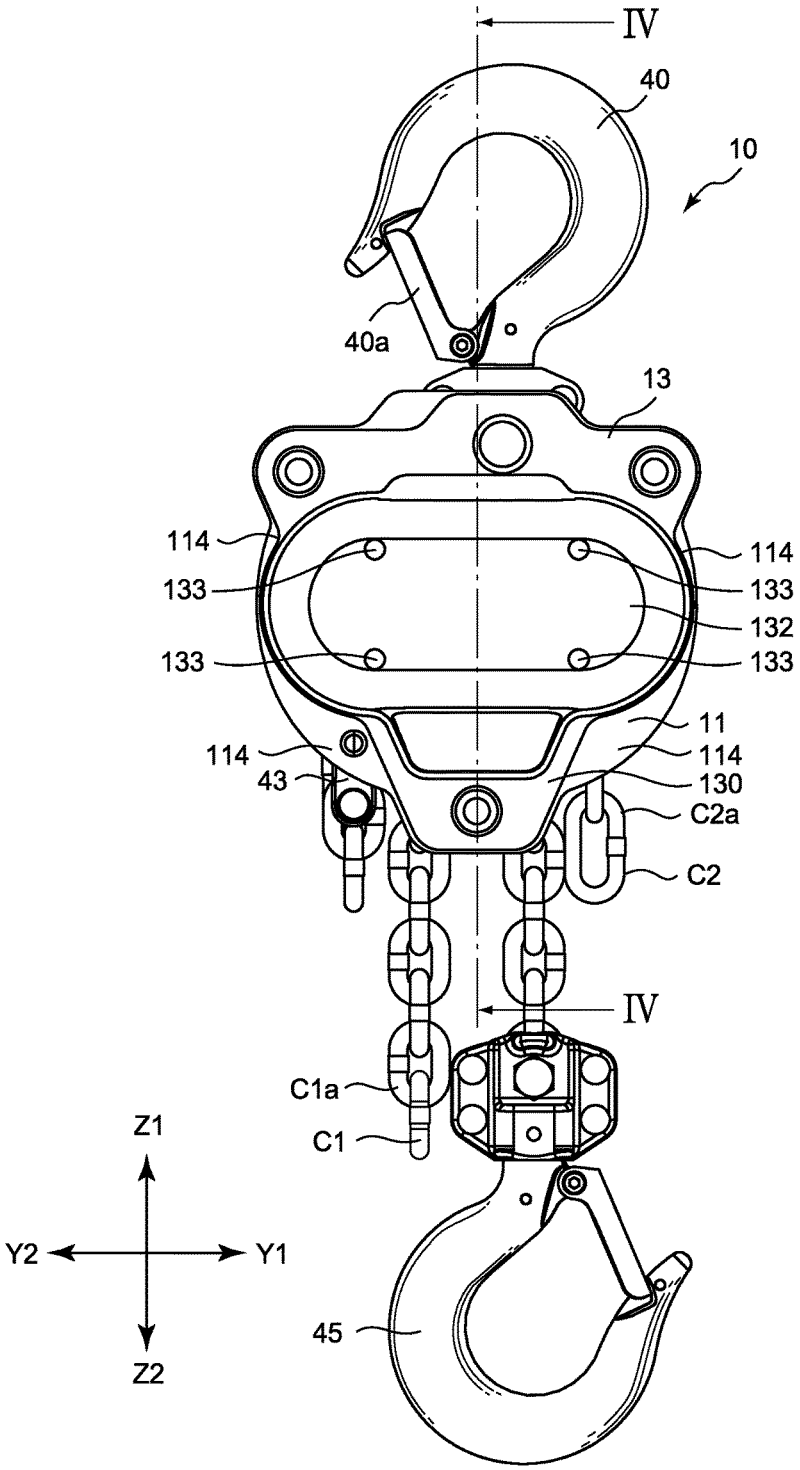
FIG. 1 is a front view illustrating an appearance of a chain block according to an embodiment of the present invention.

Hereinbelow, a chain block 10 according to an embodiment of the present invention will be described with reference to the drawings.

<About Configuration of Chain Block>

As illustrated in FIGS. 1 to 5 and the like, a chain block 10 includes a first frame 11, a second frame 12, a gear case 13, a wheel cover 14, a load sheave hollow shaft 20, and a speed reducing mechanism 30, and these are fixed via stay bolts SB (corresponding to fastening tools) and nuts N. Members are attached between the first frame 11 and the second frame 12, between the first frame 11 and the gear case 13, and between the second frame 12 and the wheel cover 14, and some of the members project from between them. The members will be described below.

Figure 4:
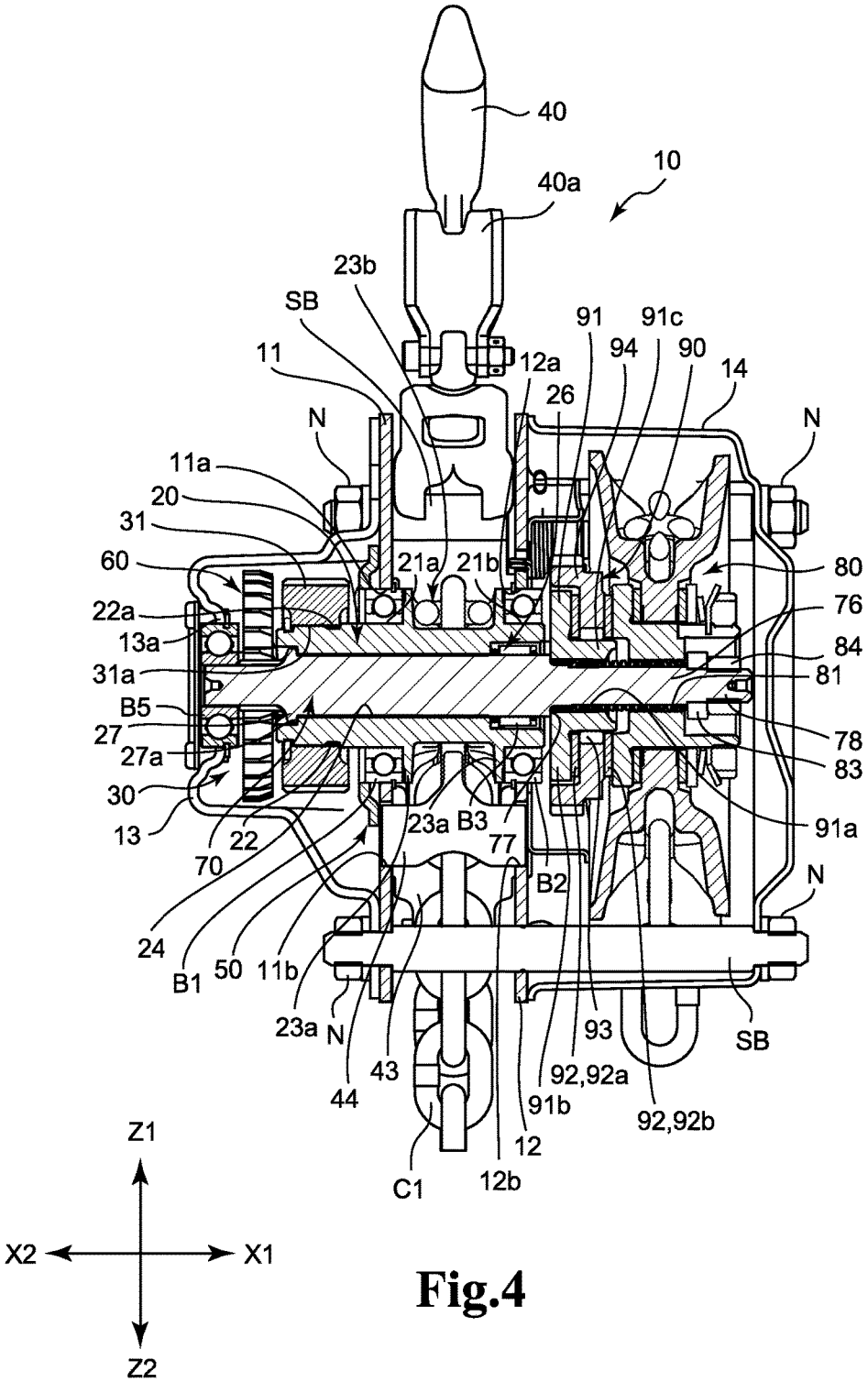
FIG. 4 FIG. 4 is a side cross-sectional view illustrating a state in which the chain block has been cut along the line IV-IV in FIG. 1.
Figure 5:
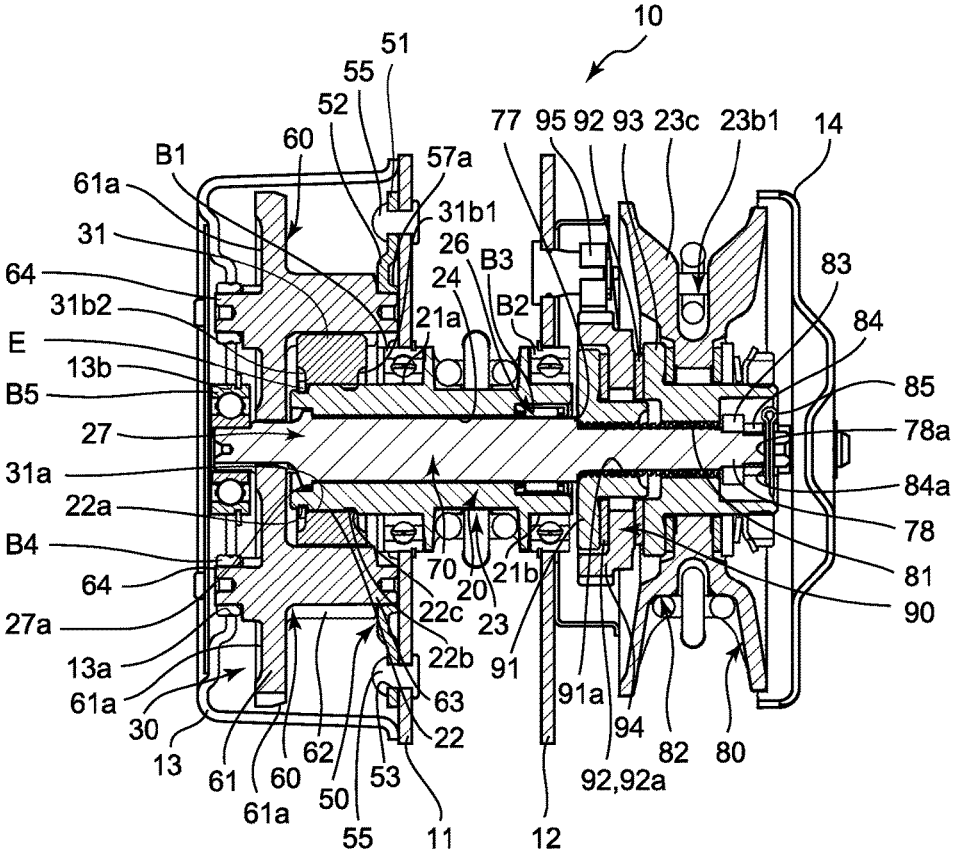
FIG. 5 is a side cross-sectional view illustrating a state in which the chain block has been cut along the line V-V in FIG. 2.

Between the first frame 11 and the second frame 12 are situated a part of the load sheave hollow shaft 20, an upper hook 40, guide rollers 42, a fastener 43, a stripper 44, and the like. As illustrated in FIGS. 4 and 5, the load sheave hollow shaft 20 is supported in the first frame 11 and the second frame 12 via bearings B1 and B2 such as ball bearings to be fitted in respective insertion holes 11*a* and 12*a* of the first frame 11 and the second frame 12. That is, on outer circumferences of bearing fitting portions 21*a* and 21*b* out of the load sheave hollow shaft 20, the bearings B1 and B2 are situated, and the bearings B1 and B2 are situated in the insertion holes 11*a* and 12*a*. Accordingly, the load sheave hollow shaft 20 is supported in the first frame 11 and the second frame 12. Meanwhile, the load sheave hollow shaft 20 corresponds to a load sheave member.

Figure 6:
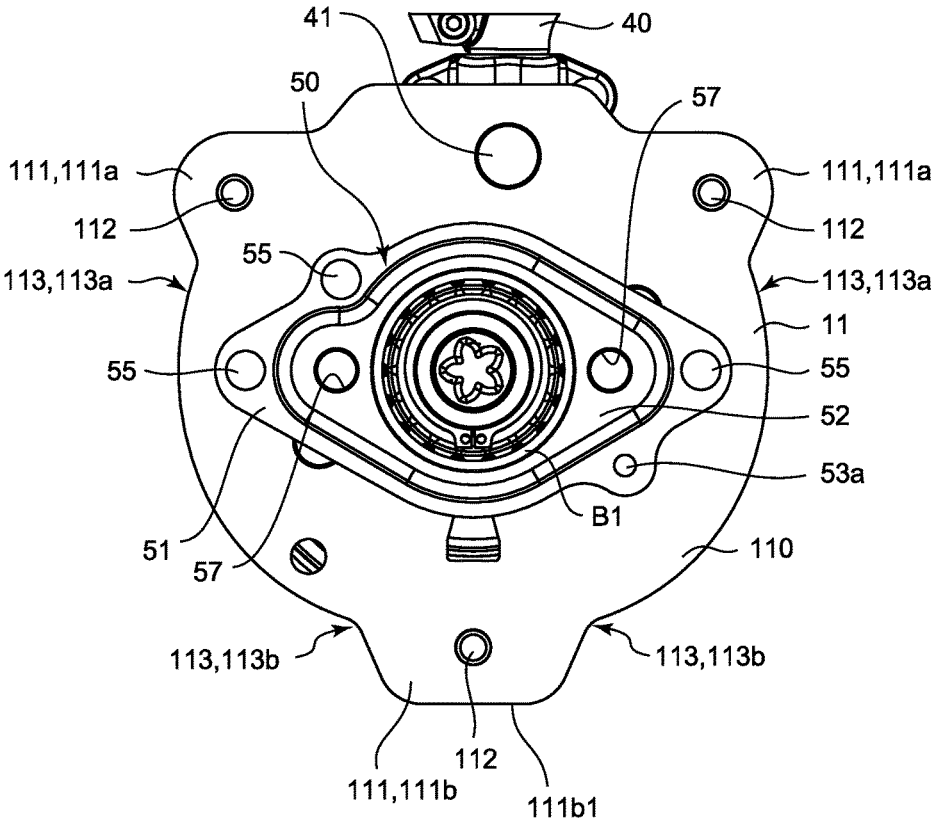
FIG. 6 is a front view illustrating shapes of a first frame and an auxiliary plate in a state in which a speed reducing gear member and a load gear are removed in the chain block in FIG. 1.
Figure 6:
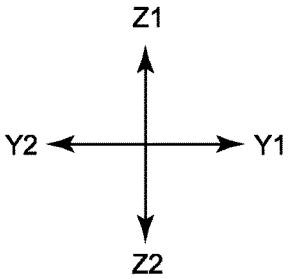
Figure 9:
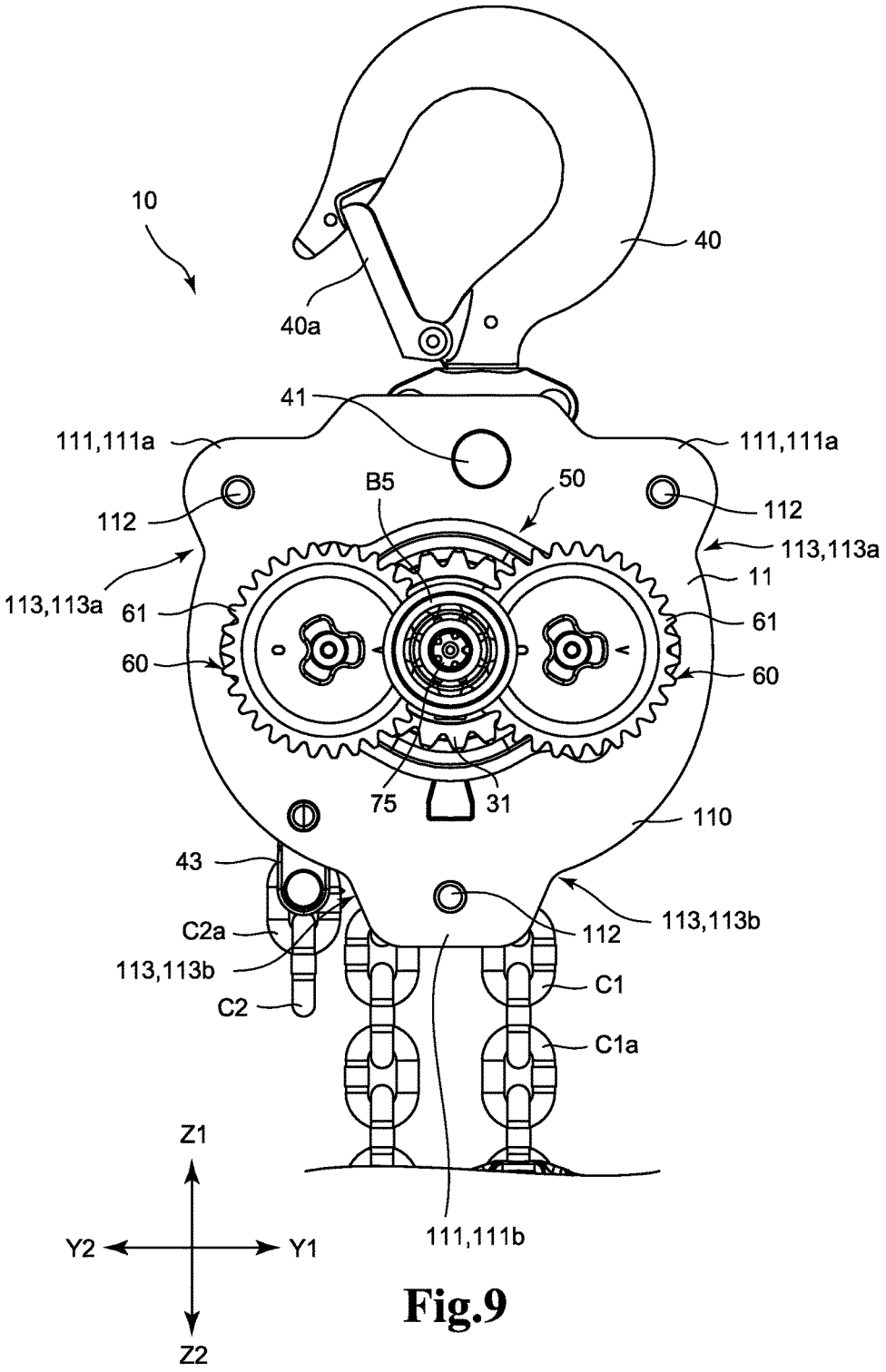
FIG. 9 illustrates arrangement of the speed reducing gear member and the load gear to the first frame in the chain block in FIG. 1.

As illustrated in FIGS. 6 and 9, the first frame 11 includes a circular portion 110 formed in a circular shape and frame projection portions 111 projecting from this circular portion 110. The three frame projection portions 111 are provided in total: two on an upper side (Z1 side) and one on a lower side (Z2 side).

Each of these frame projection portions 111 is a part for preventing rolling of the chain block 10 and a part functioning as a rolling restriction portion as described below. That is, a case in which the chain block 10 is dragged via a load chain C1 when the chain block 10 is in a standing posture in which the first frame 11 and the second frame 12 contact the ground (hereinbelow, such a posture is referred to as a standing posture) is considered. In this case, the chain block 10 almost rolls due to a tensile force via the load chain C1. However, in a case in which the frame projection portions 111 exist as in the present embodiment, such rolling is prevented, and the load chain C1 is dragged with the frame projection portion 111 kept in a state of abutting on the ground.

Meanwhile, in the present embodiment, the three frame projection portions 111 are provided to form an isosceles triangle when linear parts at side edges thereof are connected. However, the frame projection portions 111 may project from the circular portion 110 in any manner as long as the chain block 10 is prevented from rolling when it is dragged, and as long as the chain block 10 is dragged in a state of abutting on the ground. Also, in the present embodiment, although a part on which the chain block 10 is installed (installation part) is regarded as the ground, an installation part other than the ground (such as a floor) may be regarded as the ground.

Also, each of the frame projection portions 111 is provided with an insertion hole 112 in which the stay bolt SB is to be inserted. The three insertion holes 112 in total are provided to form an isosceles triangle when they are connected but may be provided to form an equilateral triangle or an approximately equilateral triangle. Also, the three insertion holes 112 in total may be provided to form a triangle other than the isosceles triangle when they are connected.

As illustrated in FIGS. 6 and 9, a pair of frame projection portions 111*a* located on the upper side (Z1 side) out of the aforementioned frame projection portions 111 is arranged along a Y direction. A part on the lower side (Z2 side) of an outer rim portion of each of the frame projection portions 111*a* and an outer rim portion of the circular portion constitute a recess 113. The recess 113 is a part which reduces a width dimension of the first frame 11 between the circular portion 110 and a lateral side on the lower side (Z2 side) of the frame projection portion 111*a*. Hence, one can grip the chain block 10 by locating separate fingers or the like on the recesses 113 as a pair. That is, one can grip or hold the chain block 10 at the recesses 113 instead of at the upper hook 40. Meanwhile, one can grip or hold the chain block 10 by locating a separate gripping tool or holding tool, instead of the fingers, on the respective recesses 113 as the pair for carriage, storage, packing, or the like of the chain block 10.

Also, in the case in which the chain block 10 is dragged in a state of the standing posture, the recess 113 does not contact the ground. Thus, the recess 113 functions to keep a distance between a part of the circular portion 110 contacting the ground and a part of the frame projection portion 111 contacting the ground. In this manner, since the circular portion 110 and the frame projection portion 111 contact the ground at separate positions, the chain block 10 is hard to roll when the chain block 10 is dragged in the standing posture.

Meanwhile, the frame projection portion 111 residing on the lower side (Z2 side) is referred to as a frame projection portion 111*b* as needed. An end surface on the Z2 side of this frame projection portion 111*b* is a flat portion 111*b*1 parallel to a Y axis, and providing the flat portion 111*b*1 enables the chain block 10 to stand by itself without falling. This facilitates carriage, storage, packing, or the like of the chain block 10.

Also, the recesses 113 are provided on both sides in the Y direction of the frame projection portion 111*b* as well. Providing each of these recesses 113 keeps a distance between a part of the circular portion 110 contacting the ground and a part of the frame projection portion 111*b* contacting the ground. Thus, the chain block 10 is hard to roll when the chain block 10 is dragged in the standing posture. In the following description, the recess 113 adjacent to the frame projection portion 111*a* is referred to as a recess 113*a* while the recess 113 on each side of the frame projection portion 111*b* is referred to as a recess 113*b*.

Figure 8:
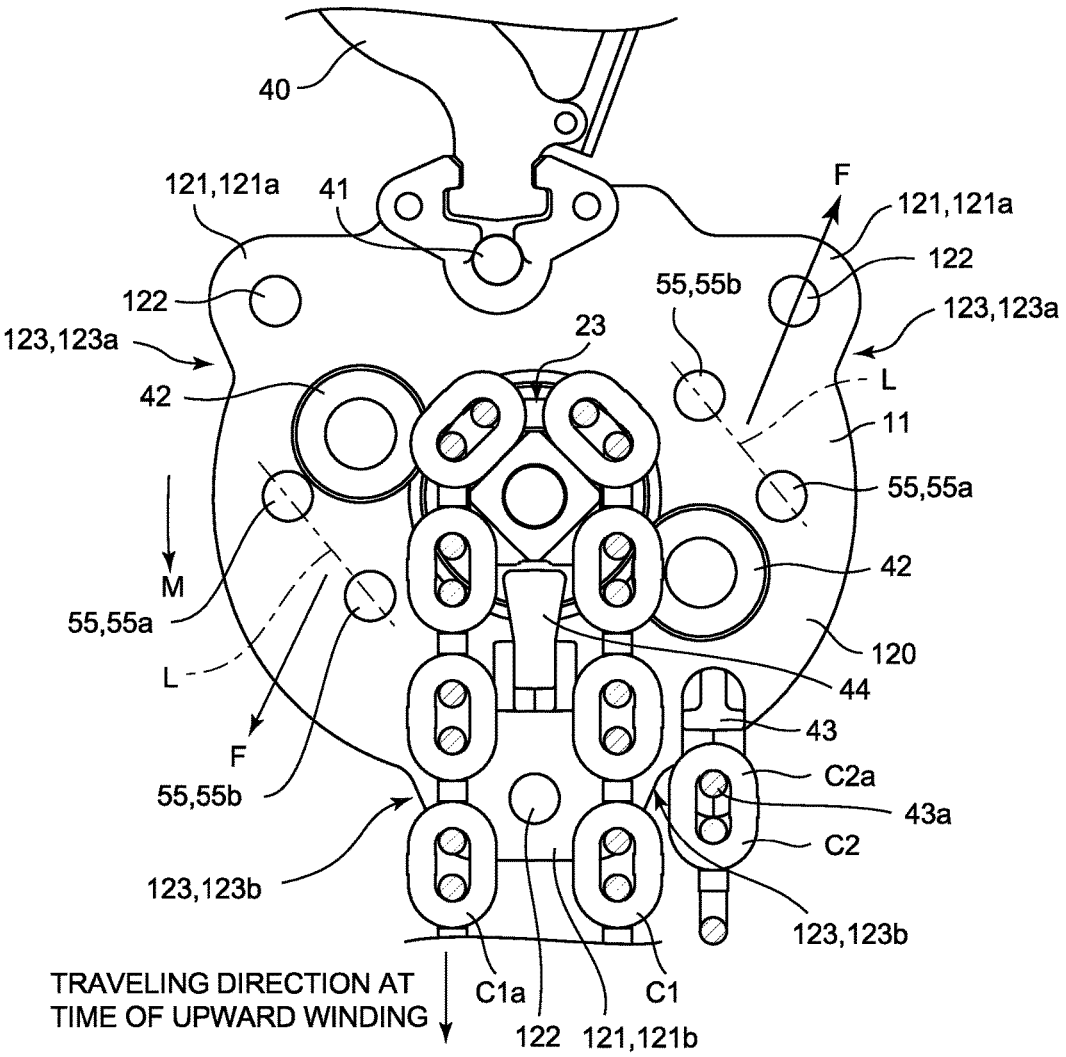
FIG. 8 illustrates positional relationship of attaching positions of fixing tools and guide rollers to the first frame in the chain block in FIG. 1.
Figure 8:
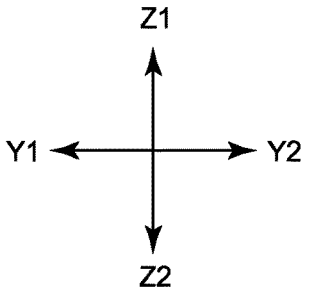

As illustrated in FIG. 8, the second frame 12 is also provided with a circular portion 120, frame projection portions 121 (121*a*, 121*b*), insertion holes 122, and recesses 123 (123*a*, 123*b*) similar to those in the aforementioned first frame 11. However, since these are configured similarly to the respective parts in the first frame 11, description of these respective parts is omitted. Also, the second frame 12 corresponds to a frame member. However, the first frame 11 may correspond to the frame member, or both the first frame 11 and the second frame 12 may correspond to the frame member.

Also, as illustrated in FIGS. 4 and 5, further on a side of the gear case 13 than the bearing fitting portion 21*a* on a side of the first frame 11 in the load sheave hollow shaft 20, a gear fitting portion 22 is provided, and on this gear fitting portion 22, a load gear 31 constituting the speed reducing mechanism 30 is held by means of a spline connection. Meanwhile, on the side of the gear case 13 in the gear fitting portion 22, a groove 22*a* to which a snap ring E is attached is provided. The snap ring E is attached to this groove 22*a* to regulate movement of the load gear 31 to an X2 side. On the other hand, at a part of the gear fitting portion 22 on a side of the bearing fitting portion 21*a* is formed a clearance groove 22*b* for a spline process, and at a part thereof further on the side of the bearing fitting portion 21*a* than the clearance groove 22*b* is provided a fixing step 22*c* having a larger diameter than that of the gear fitting portion 22. This fixing step 22*c* regulates movement of the load gear 31 to an X1 side.

The load gear 31 is provided with a center hole 31*a* in which the aforementioned gear fitting portion 22 is inserted. In addition, as illustrated in FIGS. 4 and 5, on circumferences of the center hole 31*a* in both end sides of the load gear 31 are provided recesses 31*b*. Each of the recesses 31*b* is formed in a shape in which both the end surfaces of the load gear 31 are dented to a certain extent. That is, as illustrated in FIGS. 4 and 5, a recess 31*b*1 dented in the end surface of the load gear 31 on the X1 side is opposed to the bearing B1, and existence of the recess 31*b*1 enables a space between the load gear 31 and the bearing B1 to be enlarged. Thus, in a case in which the load gear 31 is rotated in a state in which machine oil (grease) exists between the load gear 31 and the bearing B1, a mechanical loss generated by viscosity of the machine oil (grease) can be reduced, and fluidity of the machine oil (grease) can be improved at the time of rotation of the load gear 31. Similarly, a recess 31*b*2 dented in the end surface of the load gear 31 on the X2 side is opposed to a large-diameter gear 61 of a speed reducing gear member 60, and existence of the recess 31*b*2 enables a space between the load gear 31 and the large-diameter gear 61 to be enlarged. In this case as well, in a case in which the load gear 31 is rotated, a mechanical loss generated by viscosity of the machine oil (grease) can be reduced, and fluidity of the machine oil (grease) can be improved at the time of rotation of the load gear 31.

Meanwhile, the load gear 31, the speed reducing gear member 60, and a pinion gear 72 correspond to a gear member.

Also, the load sheave hollow shaft 20 has a pair of flange portions 23*a* constituting a load sheave 23 and further has between the flange portions 23*a* as the pair a chain pocket 23*b* (refer to FIG. 4) constituting the load sheave 23. The chain pocket 23*b* is a part in which a metal ring C1*a* of a load chain C1 is fitted and has a horizontal pocket (not illustrated) in which the metal ring C1*a* is fitted in a state in which a direction in which the metal ring C1*a* is flat is parallel to the axial direction (X direction) and a vertical pocket (not illustrated) which is in a deeper groove shape than the horizontal pocket and in which the metal ring C1*a* is fitted in a state in which the direction in which the metal ring C1*a* is flat intersects with the axial direction (X direction).

Also, the load sheave hollow shaft 20 is provided with a hollow hole 24. A drive shaft 70 is inserted in the hollow hole 24, and at an end portion of the hollow hole 24 on a side of the second frame 12 is provided a bearing step 26 adapted to receive a bearing B3 pivotally supporting the drive shaft 70. At an end portion of the hollow hole 24 on a side of the gear fitting portion 22 is provided a housing recess 27 adapted to receive a flange portion 71 of the drive shaft 70. Situating the flange portion 71 of the drive shaft 70 in this housing recess 27 shortens a length of the drive shaft 70 along the axial direction (X direction) and can reduce a dimension of the chain block 10 along the X direction (axial direction of the drive shaft 70). Also, shortening the chain block 10 along the axial direction of the drive shaft 70 enables strength of the drive shaft 70 to be improved.

As illustrated in FIGS. 1 to 6, the upper hook 40 is attached to the first frame 11 and the second frame 12 via a connection shaft 41 (refer to FIGS. 6 and 8) and is attached to the connection shaft 41 in a turnable state. To this upper hook 40 is attached a hook latch 40*a* biased in a closing direction by a not-illustrated biasing means.

Figure 2:
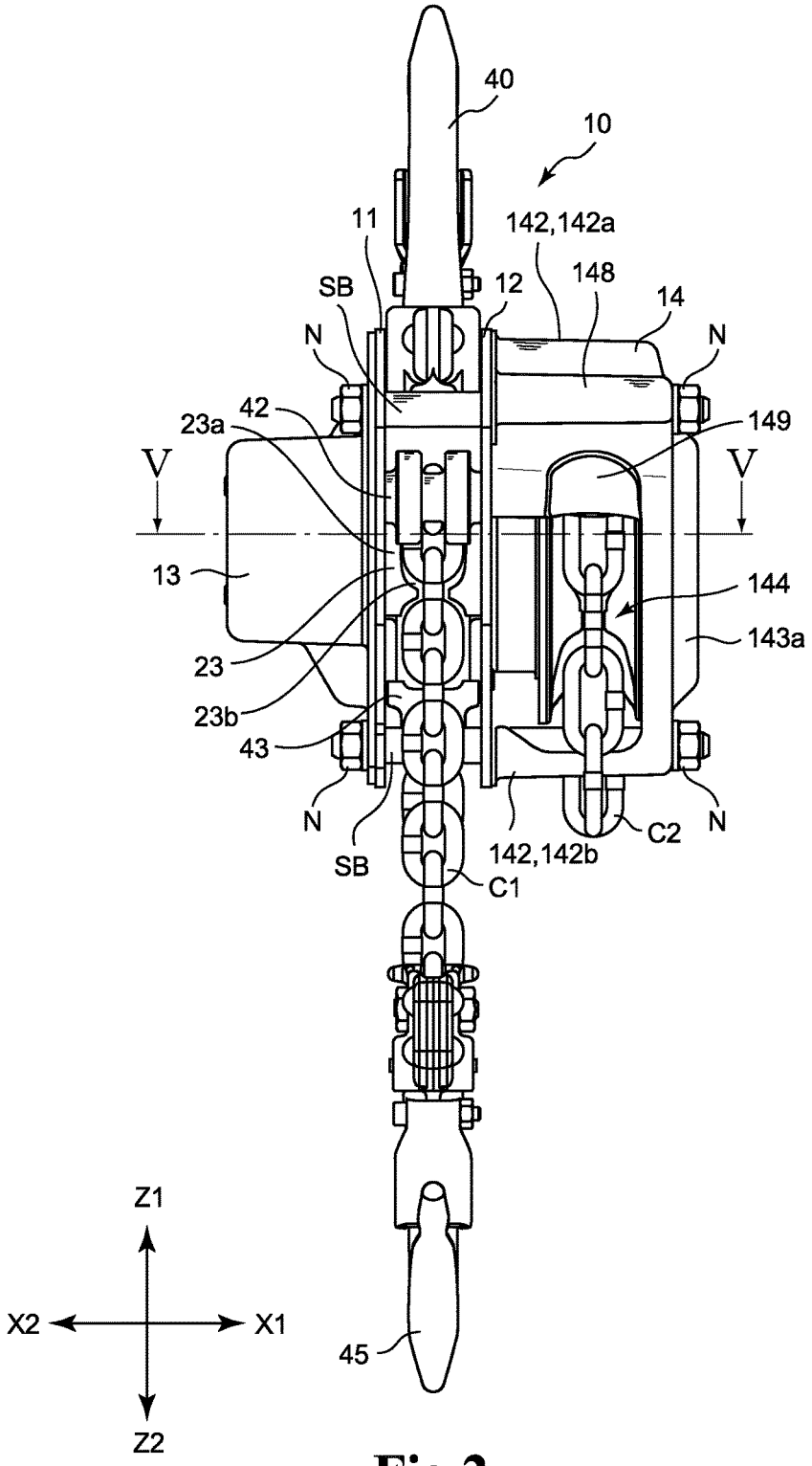
FIG. 2 is a side view illustrating the appearance of the chain block in FIG. 1.

Each of the guide rollers 42 illustrated in FIGS. 2 and 8 is rotatably pivotally supported at one end side and the other end side thereof by the first frame 11 and the second frame 12, and in an example, the guide rollers 42 are provided as a pair at intervals of 180 degrees with a center of the load sheave hollow shaft 20 interposed therebetween. Each of these guide rollers 42 is a member which is rotated along with upward winding or the like of the load chain C1 and is attached to be opposed to the load sheave 23 away from a distance preventing the load chain C1 from coming off of the chain pocket 23*b*.

The fastener 43 illustrated in FIGS. 1 to 4 and FIG. 9 is a part to which is attached a metal pin 43*a* to be inserted in the metal ring C1*a* of the load chain C1 at an opposite end of a side to which a lower hook 45 is attached. This fastener 43 is rotatably pivotally supported at one end side and the other end side thereof by the first frame 11 and the second frame 12 as well.

The stripper 44 illustrated in FIG. 4 is a member which prevents generation of a lock state, in which the load chain C1 wound around the load sheave 23 follows the load sheave 23 more than necessary to disable rotation of the load sheave 23. Respective end portions of this stripper 44 on one end side and the other end side are inserted in respective support holes 11*b* and 12*b* residing in the first frame 11 and the second frame 12 to cause the stripper 44 to be attached to the first frame 11 and the second frame 12.

Figure 7A:
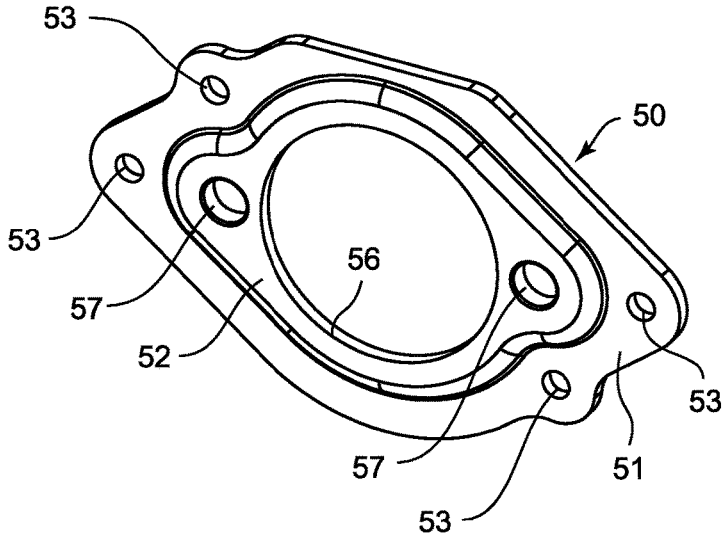
FIGS. 7(A) and 7(B) are perspective views illustrating a shape of the auxiliary plate in the chain block in FIG. 1.
Figure 7B:
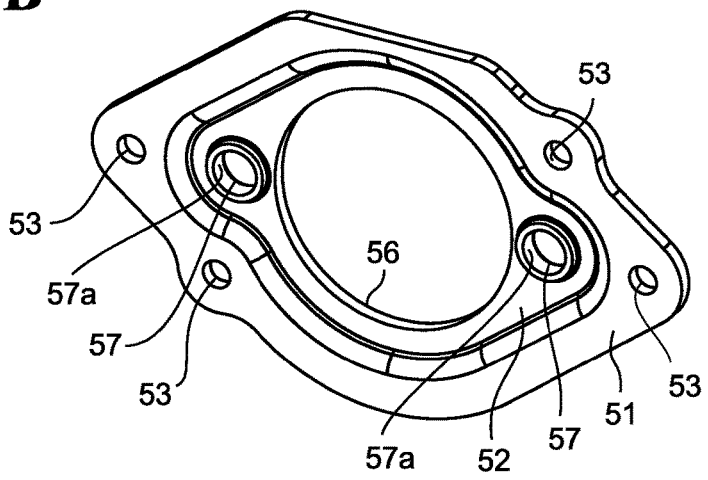

Also, as illustrated in FIGS. 4 to 6, to an end surface of the first frame 11 on a side opposed to the gear case 13 is attached an auxiliary plate 50 illustrated in FIGS. 7(A) and 7(B). The auxiliary plate 50 is provided with a flange portion 51 and a draw portion 52. The flange portion 51 is a part which contacts the end surface of the first frame 11 and is provided with fixing holes 53. By inserting fixing tools 55 (refer to FIG. 5) such as rivets into the fixing holes 53 and attaching holes 11*c* provided in the first frame 11, the auxiliary plate 50 is attached to the first frame 11. Also, the draw portion 52 is a part situated further on a center side than the flange portion 51 and is a part formed by means of drawing, for example, so that a center side of the auxiliary plate 50 may be spaced apart from the end surface of the first frame 11 over a predetermined distance. In the present embodiment, the draw portion 52 has recessed portions exist on an outer circumferential side thereof due to existence of the fixing holes 53 but is formed approximately in a rhombus shape with rounded corners except the recessed portions in the configuration illustrated in FIGS. 6, 7(A), and 7(B).

Here, attaching positions of the aforementioned fixing tools 55 and the guide rollers 42 to the first frame 11 have positional relationship as illustrated in FIG. 8. That is, the guide rollers 42 as the pair are attached proximately to any fixing tools 55, respectively, and are arranged at symmetric positions with a center between the guide rollers 42 interposed therebetween. Also, each of the guide rollers 42 is provided proximately to the fixing tool 55 (55*a*) which is further away from a rotation center of the load sheave 23 and the like and provided at a position spaced apart from the fixing tool 55 (55*b*) which is closer to the center with the Y direction interposed therebetween. By adopting such arrangement, when the load chain C1 is wound up, the entire chain block 10 intends to turn along a turning direction M in FIG. 8 so that a force F applied by the load chain C1 is directed perpendicularly to a line L connecting the fixing tools 55 which are proximate to each other. In a case of arrangement of the guide rollers 42 as illustrated in FIG. 8, at the time of such turning, a line connecting the guide rollers 42 as the pair is in a nearly horizontal state, which enables guiding performance for the load chain to be maintained favorably.

Also, as illustrated in FIGS. 6, 7(A), and 7(B), on a center side of the draw portion 52 is provided a center hole 56. The center hole 56 is provided coaxially with the aforementioned insertion hole 11*a* and has a similar diameter to that of the insertion hole 11*a*. The aforementioned bearing B1 is situated in the center hole 56 to support the load sheave hollow shaft 20. The draw portion 52 is also provided with bearing holes 57 along a longer diagonal line thereof formed approximately in a rhombus shape. The bearing holes 57 are provided as a pair, for example, at positions equally distant from a center of the center hole 56 and are formed in shapes each having an erecting portion 57*a* by means of burring, for example. Each of these bearing holes 57 has a pivotally supporting portion 63 of the speed reducing gear member 60 on one end side (X1 side in FIG. 5) inserted therein to pivotally support the speed reducing gear member 60. Meanwhile, a pivotally supporting portion 64 of the speed reducing gear member 60 on the other end side (X2 side in FIG. 5) is inserted in a bearing hole 13*a* of the gear case 13 via a bearing B4 such as a bush, and the speed reducing gear member 60 is pivotally supported by the bearing hole 13*a*.

Figure 10A:
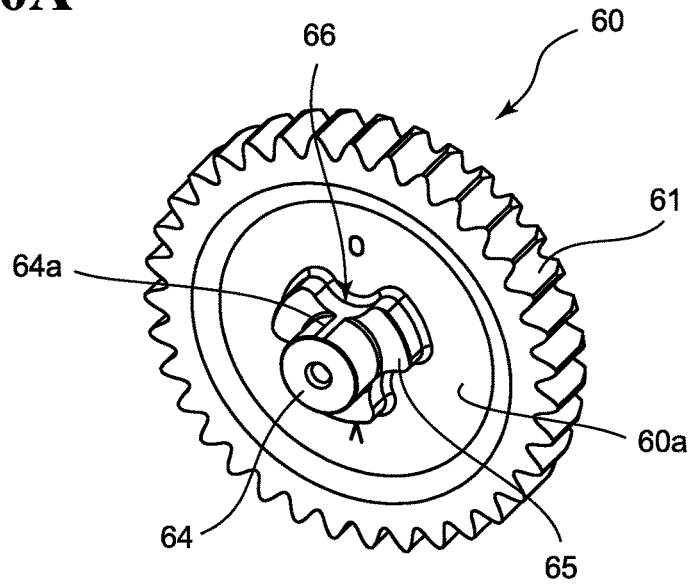
FIGS. 10(A) and 10(B) are perspective views illustrating a shape of the speed reducing gear member in the chain block in FIG. 1.
Figure 10B:
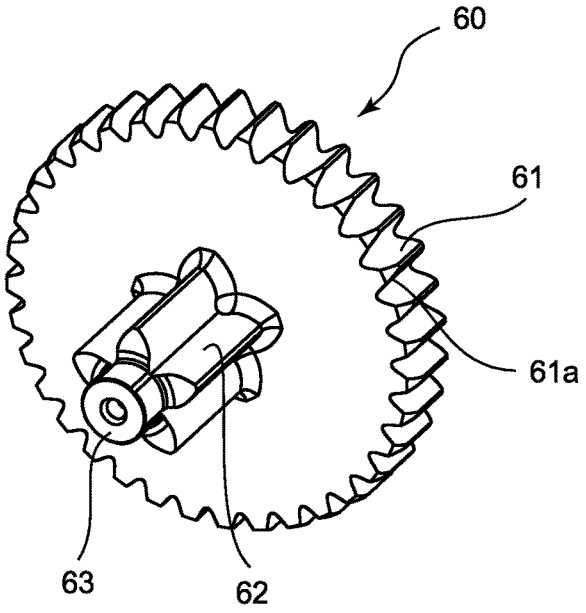

As illustrated in FIGS. 5, 10(A), and 10(B), each of the speed reducing gear members 60 as a pair (arrangement of the pair of speed reducing gear members 60 is illustrated in FIG. 9 as well) is provided with the large-diameter gear 61 (corresponding to a first speed reducing gear portion) and a small-diameter gear 62 (corresponding to a second speed reducing gear portion) and is further provided with the pivotally supporting portion 63 to be inserted into the aforementioned bearing hole 57 and the pivotally supporting portion 64 to be inserted into the bearing hole 13*a*. The large-diameter gear 61 meshes with a pinion gear 72 of the drive shaft 70, and a drive force from the drive shaft 70 is transmitted to the speed reducing gear member 60 at a first speed reducing ratio. Also, the large-diameter gear 61 is provided with a chamfered portion 61*a*. The chamfered portion 61*a* is provided at a part of an outer circumferential side of the large-diameter gear 61 on the X1 side and is provided to have a smaller diameter than those of the other parts of the large-diameter gear 61. Existence of this chamfered portion 61*a* prevents the large-diameter gear 61 from interfering with an inclined portion 73 and a curved portion 74 of the drive shaft 70.

Also, the small-diameter gear 62 meshes with the load gear 31 and transmits the drive force transmitted to the speed reducing gear member 60 to the load gear 31 at a second speed reducing ratio. Meanwhile, this small-diameter gear 62 and the aforementioned large-diameter gear 61 are integrally formed by means of cold forging, for example. However, the small-diameter gear 62 and the large-diameter gear 61 may be integrally formed by means of combination of other processes such as precision forging and cutting or may be formed by forming them separately by means of combination of the above processes and then connecting them.

As illustrated in FIG. 10(A), further on a side (X1 side) of the large-diameter gear 61 than the pivotally supporting portion 64 in the speed reducing gear member 60 are provided expanding portions 65. The expanding portions 65 are provided in a recess 60*a* provided at a center part on an end surface of the speed reducing gear member 60. These expanding portions 65 are parts expanding outward in the radial direction so as to have larger diameters than that of the pivotally supporting portion 64 and expand intermittently along the circumferential direction (in FIG. 10(A), three expanding portions 65 are provided). Between the adjacent expanding portions 65 is provided a dented portion 66 having a relatively smaller diameter than that of the expanding portion 65. Also, on an outer circumferential side of the pivotally supporting portion 64 is provided an oil groove 64*a* along the axial direction (X direction) of the speed reducing gear member 60, and this oil groove 64*a* communicates with any of the dented portions 66. This enables the machine oil (grease) to be supplied to the bearing B4 such as a bush via the recess 60*a* and the oil groove 64*a*. Also, existence of the aforementioned expanding portions 65 enables the large-diameter gear 61 to be away from the bearing B4, and existence of the recess 60*a* and the oil groove 64*a* enables a mechanical loss generated by viscosity of the machine oil (grease) to be reduced and enables fluidity of the machine oil (grease) to be improved between the large-diameter gear 61 and the bearing B4 or B5.

Figure 11A:
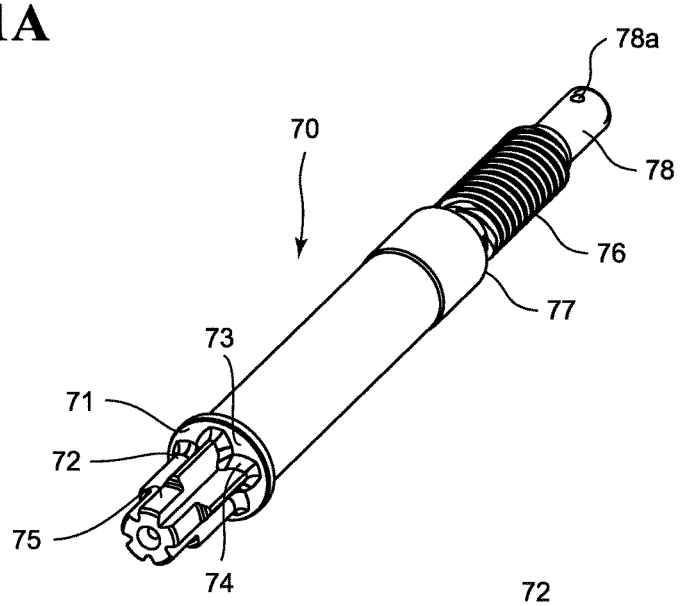
FIGS. 11(A), 11(B), and 11(C) illustrate a shape of a drive shaft in the chain block in FIG. 1.
Figure 11B:
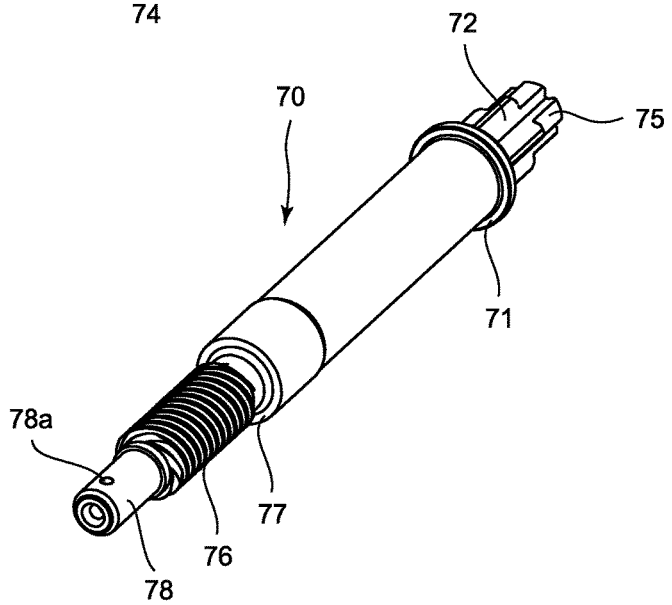
Figure 11C:
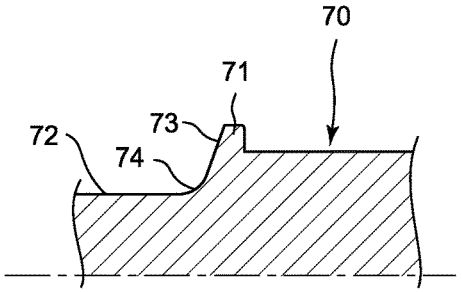

As illustrated in FIGS. 4 and 5, the drive shaft 70 (refer to FIGS. 11(A) to 11(C)) is a member extending from a side of the gear case 13 to a side of a hand wheel 80 along the X direction. This drive shaft 70 passes through the hollow hole 24 of the load sheave hollow shaft 20 as described above and is provided to be rotatable with respect to the load sheave 23 via the bearing B3 of the bearing step 26. The drive shaft 70 is also provided with the flange portion 71, and this flange portion 71 is situated in the housing recess 27. The flange portion 71 is received in a bottom portion 27*a* of the housing recess 27 to regulate movement of the drive shaft 70 to the side of the hand wheel 80 and enable a dimension of the drive shaft 70 in the axial direction to be reduced.

Figure 12A:
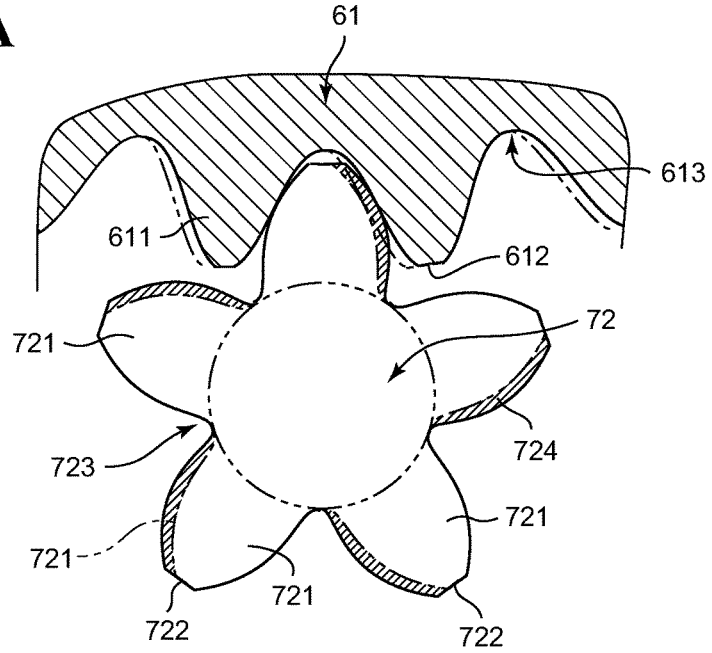
FIG. 12(A) illustrates a meshing state of a pinion gear with a large-diameter gear in the present embodiment.
Figure 12B:
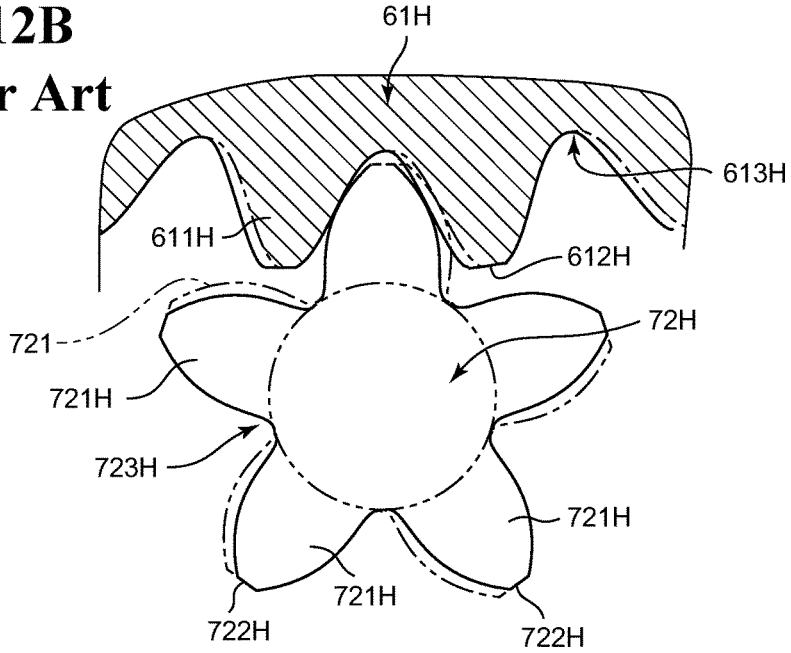
Fig.12B Prior Art
FIG. 12(B) illustrates a meshing state of a pinion gear with a large-diameter gear in a conventional configuration.

At a part of this drive shaft 70 projecting from the hollow hole 24 to the side of the gear case 13 (X2 side) is provided the pinion gear 72 (corresponding to a first gear) meshing with the aforementioned large-diameter gear 61. In FIG. 12(A), the pinion gear 72 has five teeth 721. A tooth thickness Da of each tooth 721 of this pinion gear 72 is set to differ from a tooth thickness Db of a tooth 721H of a conventional pinion gear 72H as illustrated in FIG. 13(B). That is, in the pinion gear 72 according to the present embodiment, the tooth thickness Da (hereinbelow, the tooth thickness Da of a tooth tip 722 is referred to as a tooth thickness Da2 as illustrated in FIG. 13(A)) of the tooth tip 722 of each tooth 721 is set to be larger than the tooth thickness Db (hereinbelow, the tooth thickness Db of a tooth tip 722H is referred to as a tooth thickness Db2 as illustrated in FIG. 13(B)) of the tooth tip 722H of each tooth 721H.

Meanwhile, in the case in which the tooth thickness Da2 of the tooth tip 722 is set to be larger than the tooth thickness Db2 of the conventional tooth tip 722H as described above, the tooth thickness Da of each tooth 721 can be as follows. That is, in the pinion gear 72 according to the present embodiment, a dimension Ba (not illustrated) of a tooth bottom 723 residing between the adjacent teeth 721 is set to be smaller than a dimension Bb (not illustrated) of a tooth bottom 723H of the conventional pinion gear 72H. Thus, on a side of the tooth bottom 723, the tooth thickness Da (hereinbelow, the tooth thickness Da on the side of the tooth bottom 723 is referred to as a tooth thickness Da1 as illustrated in FIG. 13(A)) of the tooth 721 is set to be larger than the tooth thickness Db (hereinbelow, the tooth thickness Db on the side of the tooth bottom 723 is referred to as a tooth thickness Db1 as illustrated in FIG. 13(B)) of the conventional tooth 721.

Figure 13A:
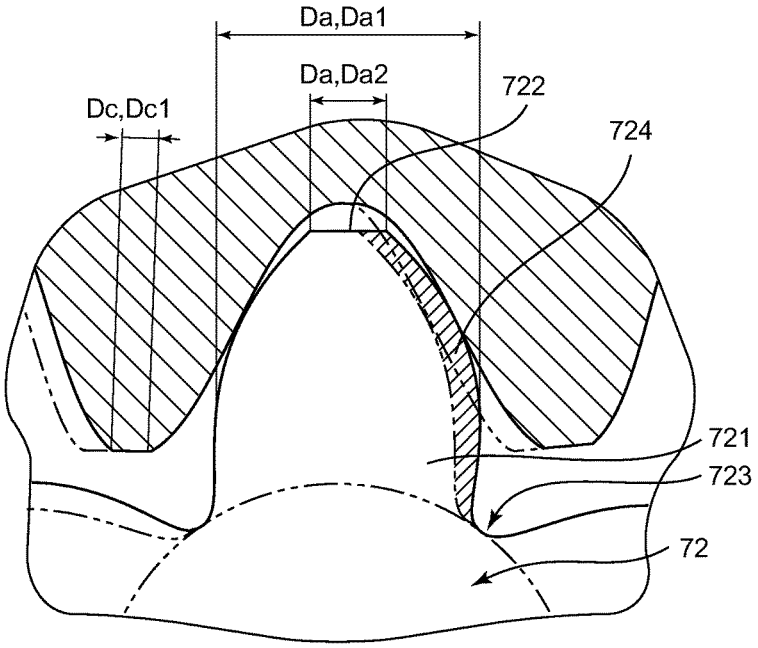
FIG. 13(A) illustrates relationship of tooth thicknesses of the pinion gear and the large-diameter gear in the present embodiment.
Figure 13B:
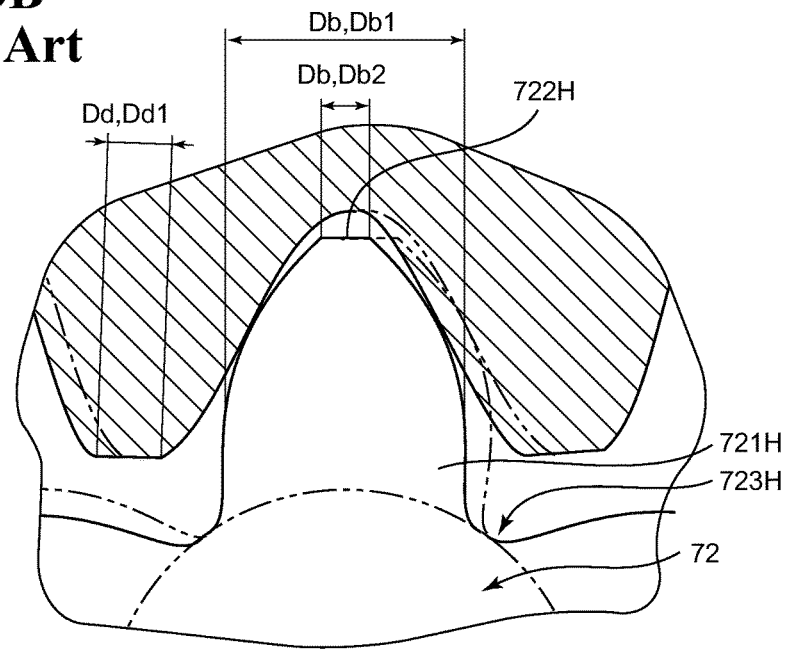
Fig.13B Prior Art
FIG. 13(B) illustrates relationship of tooth thicknesses of the pinion gear and the large-diameter gear in the conventional configuration.

In addition, as illustrated in FIGS. 13(A) and 13(B), the tooth thicknesses Da and Db at respective parts of the teeth 721 and 721H are considered. In this case, in the configuration illustrated in FIG. 13(A), the ratio of a thickened portion 724 in the tooth thickness Da of the tooth 721 in the present embodiment is set to increase from the side of the tooth bottom 723 to a side of the tooth tip 722, as compared with the tooth thickness Db of the conventional tooth 721H. Accordingly, since the ratio of the thickened portion 724 is larger on the side of the tooth tip 722, strength of the tooth 721 on the side of the tooth tip 722 can be improved significantly.

It is to be noted that the tooth thickness Da of each tooth 721 may be set as follows. That is, the tooth thickness Da1 on the side of the tooth bottom 723 may be set to be approximately equal to the tooth thickness Db1 of the conventional tooth 721H on the side of the tooth bottom 723H. However, in this case, it is necessary to prevent undercut from being generated on the side of the tooth bottom 723. It is to be noted that, in the case in which the tooth thickness Da1 on the side of the tooth bottom 723 is set to be approximately equal to the tooth thickness Db1 of the conventional tooth 721H on the side of the tooth bottom 723H as described above, a dimension of the thickened portion 724 may be set to increase from the tooth bottom 723 to the tooth tip 722.

Also, each tooth 611 of the large-diameter gear 61 meshing with the aforementioned pinion gear 72 is thinned to the extent of thickening of the thickened portion 724 of the tooth 721. That is, in the large-diameter gear 61, a tooth thickness Dc (refer to FIG. 13(A)) of the tooth 611 is smaller than a tooth thickness Dd (refer to FIG. 13(D)) of a conventional tooth 611H as much as the increasing amount from the tooth thickness Db of the tooth 721H of the conventional pinion gear 72H to the tooth thickness Da of the tooth 721 of the pinion gear 72. At this time, the tooth thickness Da2 of the tooth tip 722 of the pinion gear 72 is set to be larger than a tooth thickness Dc1 of a tooth tip 612 of the large-diameter gear 61. Here, as for a part at which the tooth 721 and the tooth 611 contact each other, the changing amount of the tooth thickness Da (thickened portion 724) of the tooth 721 in the pinion gear 72 from the side of the tooth bottom 723 to the side of the tooth tip 722 corresponds to the changing amount of the tooth thickness Dc of the tooth 611 in the large-diameter gear 61 from a side of the tooth tip 612 to a side of a tooth bottom 613. This achieves favorable mesh between the pinion gear 72 and the large-diameter gear 61.

Meanwhile, in the configuration illustrated in FIGS. 12(A) to 13(B), the pinion gear 72 is provided with the five teeth 721 while the large-diameter gear 61 is provided with the thirty five teeth 611. Also, the large-diameter gears 61 as a pair (speed reducing gear members 60) are arranged at symmetric positions with the pinion gear 72 interposed therebetween, and the pinion gear 72 meshes with both the large-diameter gears 61 as the pair. Accordingly, when the teeth 611 of the large-diameter gear 61 are rotated once, the teeth 611 of the large-diameter gear 61 contact the teeth 721 of the pinion gear 72 only once, and the teeth 721 of the pinion gear 72 contact the teeth 611 of the large-diameter gear 61 fourteen times during each rotation of the large-diameter gear 61.

Also, each of the speed reducing gear member 60 and the drive shaft 70 is made of a metal and is preferably made of an iron-based metal from a viewpoint of abrasion resistance. Also, the speed reducing gear member 60 and the drive shaft 70 are preferably made of similar materials. However, at least the pinion gear 72 out of the drive shaft 70 may be made of a material more excellent in abrasion resistance than that of the large-diameter gear 61 of the speed reducing gear member 60.

At the part of the drive shaft 70 projecting from the hollow hole 24 to the side of the gear case 13 (X2 side) is provided the pinion gear 72 (corresponding to a gear portion) meshing with the aforementioned large-diameter gear 61. As illustrated in FIGS. 11(A) and 11(C), at a base end part in the pinion gear 72 with respect to the flange portion 71 is provided the inclined portion 73. Further, between the respective teeth of the pinion gear 72 and the inclined portion 73 is provided the predetermined curved portion 74. The curved portion 74 is formed in a round shape, for example. Existence of the inclined portion 73 and curved portion 74 can prevent stress concentration from being generated on a border part of the pinion gear 72 and the flange portion 71. It is to be noted that the curved portion 74 has only to be 1/10 or larger of the inclined portion 73, and by setting the ratio thereof in the inclined portion 73 to 1/10 or larger, the stress concentration can be prevented favorably.

Here, the tooth thickness on the tip end side of the tooth of the pinion gear 72 is set to be larger than the tooth thickness on the tip end side of the large-diameter gear 61 meshing with the pinion gear 72. Accordingly, lifetime of the pinion gear 72 can be extended. That is, since the number of teeth of the pinion gear 72 is smaller than the number of teeth of the large-diameter gear 61, the number of times of sliding of the respective teeth of the pinion gear 72 is larger than that of the respective teeth of the large-diameter gear 61. Thus, the respective teeth of the pinion gear 72 are abraded earlier than the respective teeth of the large-diameter gear 61. However, by setting the tooth thickness on the tip end side of the tooth of the pinion gear 72 to be larger than the tooth thickness on the tip end side of the large-diameter gear 61 and setting the tooth width to be larger, lifetime of the pinion gear 72 can be extended.

Also, further on the side of the gear case 13 (X2 side) than the pinion gear 72 in the drive shaft 70 is provided a pivotally supporting portion 75. The pivotally supporting portion 75 is a part to which the bearing B5 is attached on an outer circumferential side thereof, and this bearing B5 is attached to a bearing attaching portion 13*b* provided in the gear case 13. Accordingly, an end portion on the X2 side of the drive shaft 70 is rotatably supported by the gear case 13 via the bearing B5. Further, on the side of the hand wheel 80 in the drive shaft 70 is provided a male screw portion 76. The male screw portion 76 is a part by which a female screw portion 81 of the hand wheel 80 and a female screw portion 91*a* of a brake receiver 91 are screwed. At an end portion on the X2 side of the male screw portion 76 is provided a step 77, and the below-mentioned brake receiver 91 is locked by this step 77. Also, further on the X1 side than the male screw portion 76 is provided a stopper receiving portion 78 having a pin hole 78*a*, and a below-mentioned wheel stopper 84 is arranged on this stopper receiving portion 78 and is prevented from coming off by a stopper pin 79.

As illustrated in FIGS. 1, 2, and 4, the gear case 13 is a member which covers the speed reducing mechanism 30 including the speed reducing gear member 60 and the load gear 31 and is fixed on the first frame 11 via the stay bolts SB and the nuts N. This gear case 13 functions as a falling prevention portion. The gear case 13 also includes an attaching plate portion 130 and a gear storage portion 131. The attaching plate portion 130 is a part surface-contacting the first frame 11. Meanwhile, the gear case 13 may be formed by deep-drawing a plate or the like.

In the present embodiment, the attaching plate portion 130 is formed in a similar shape to the aforementioned shape formed by connecting the linear parts of the three frame projection portions 111. However, when the chain block 10 is dragged, the first frame 11 rather than the gear case 13 is preferably dragged. For this reason, the attaching plate portion 130 is provided so that, around each of the frame projection portions 111, the frame projection portion 111 may project further outward than the attaching plate portion 130.

As illustrated in FIGS. 1, 2, and 4, the gear storage portion 131 is formed in a shape of being raised to the X2 side from the attaching plate portion 130. In the present embodiment, a projecting height of the gear storage portion 131 from the attaching plate portion 130 is set to be longer than a distance between the first frame 11 and the second frame 12. However, any height of the gear storage portion 131 may be set as long as it enables a favorable posture return in a case of falling of the chain block 10.

As illustrated in FIG. 1, a name plate 132 is attached to the gear storage portion 131 via rivets 133. To enable such attaching, the gear storage portion 131 is provided with not-illustrated hole portions in which the rivets 133 are to be inserted.

Also, as illustrated in FIG. 1, positional relation between an outer rim portion of the first frame 11 and an outer rim portion of the gear case 13 is as follows. That is, around each of the frame projection portions 111, the projecting amount of the outer rim portion of the first frame 11 with respect to the outer rim portion of the gear case 13 is set to be small. However, on a lower side of each of the recesses 113*a* and on an upper side of each of the recesses 113*b*, the projecting amount of the outer rim portion of the first frame 11 with respect to the outer rim portion of the gear case 13 is set to be large. Hereinbelow, a part of the first frame 11 whose projecting amount with respect to the outer rim portion of the gear case 13 is larger than that around the frame projection portion 111 is referred to as a stretching portion 114. The stretching portion 114 on the upper side of the recess 113*b* projects from the outer rim portion of the gear case 13 more significantly than the stretching portion 114 on the lower side of the recess 113*a*. Providing such stretching portions 114 enables a dragged part to be away from the gear storage portion 131 even in a case in which the chain block 10 is dragged.

As illustrated in FIGS. 4 and 5, over an end surface on a side not opposed to the first frame 11 in the second frame 12 are provided the hand wheel 80 and a brake mechanism 90. The hand wheel 80 has the female screw portion 81 on a center side thereof, and this female screw portion 81 is screwed by the male screw portion 76 of the drive shaft 70. Also, between opposed flange portions 80*a* as a pair on an outer circumferential side of the hand wheel 80 is provided a chain pocket 82 similar to that of the load sheave 23 described above. The chain pocket 82 is a part in which a metal ring C2*a* of a hand chain C2 is fitted and has a horizontal pocket (not illustrated) in which the metal ring C2*a* is fitted in a state in which a direction in which the metal ring C2*a* is flat is parallel to the axial direction and a vertical pocket (not illustrated) which is in a deeper groove shape than the horizontal pocket and in which the metal ring C2*a* is fitted in a state in which the direction in which the metal ring C2*a* is flat intersects with the axial direction. Meanwhile, further on a tip end side (X1 side) of the male screw portion 76 than the hand wheel 80 is provided the wheel stopper 84 via a collar 83 or the like. The wheel stopper 84 is a ring-like member and has a through hole 84*a* along the radial direction thereof. By inserting the stopper pin 85 into this through hole 84*a* and the pin hole 78*a* of the stopper receiving portion 78, movement of the wheel stopper 84 in the X direction of the drive shaft 70 is regulated. Existence of this wheel stopper 84 regulates movement of the hand wheel 80 to the X1 side.

Also, the brake mechanism 90 includes main components such as the brake receiver 91, brake plates 92, a ratchet wheel 94, and pawl members 95 and the like. As illustrated in FIGS. 4 and 5, on a side of the second frame 12 in the male screw portion 76 of the drive shaft 70 is arranged the brake receiver 91. The brake receiver 91 has the female screw portion 91*a* on a center side thereof and further has a flange portion 91*b* and a hollow boss portion 91*c*. The female screw portion 91*a* is a part to be screwed by the male screw portion 76 of the drive shaft 70, and this screwing causes the flange portion 91*b* of the brake receiver 91 to be locked by the step 77. The flange portion 91*b* is a part set to have a larger diameter than the hollow boss portion 91*c* and can receive the below-mentioned brake plate 92. The hollow boss portion 91*c* is situated further on the side of the hand wheel 80 (X1 side) than the flange portion 91*b* and supports the ratchet wheel 94 via a below-mentioned bush 93.

The brake plate 92 (92*a*) is situated between the flange portion 91*b* and the below-mentioned ratchet wheel 94 and applies a large friction force between the flange portion 91*b* and the below-mentioned ratchet wheel 94 in a case of being pressed from the side of the hand wheel 80, and this large friction force brings about a state in which the brake receiver 91 is rotated integrally with the ratchet wheel 94. Meanwhile, the brake plate 92 (92*b*) is arranged between the ratchet wheel 94 and the hand wheel 80 as well and applies a large friction force between the ratchet wheel 94 and the hand wheel 80 due to press from the side of the hand wheel 80, and this large friction force brings about a state in which the hand wheel 80 is rotated integrally with the ratchet wheel 94.

Figure 14:
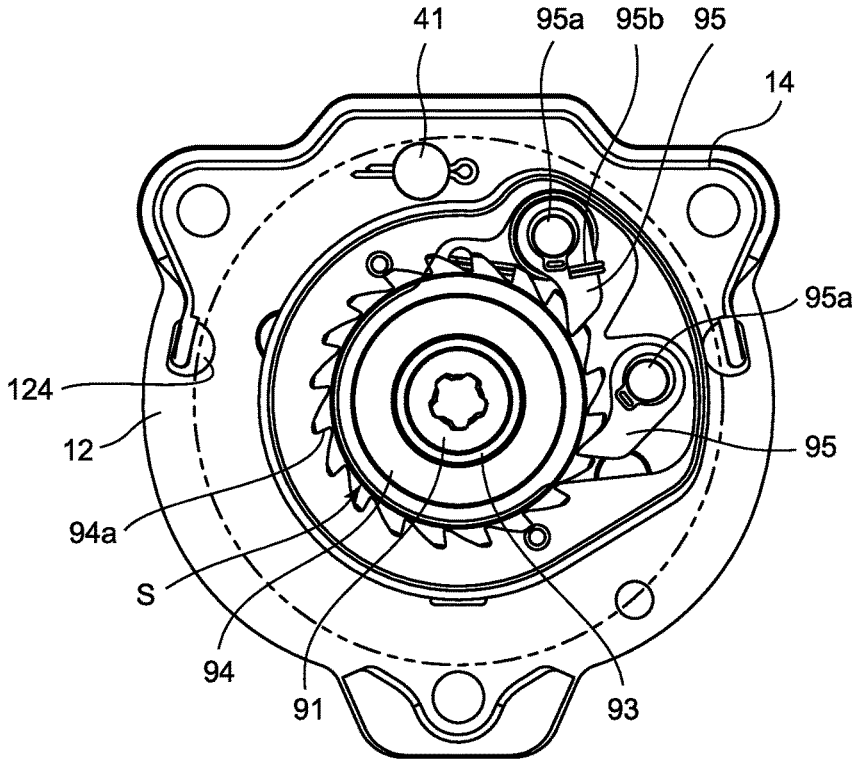
FIG. 14 illustrates arrangement of a ratchet wheel and pawl members in the chain block in FIG. 1.
Figure 14:
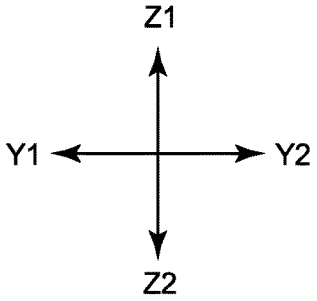

As illustrated in FIGS. 4 and 5, to the hollow boss portion 91*c* of the brake receiver 91 is attached the bush 93, and on an outer circumferential side of this bush 93 is provided the ratchet wheel 94. Accordingly, the ratchet wheel 94 is provided rotatably with respect to the brake receiver 91. As illustrated in FIG. 14, a ratchet mechanism is constructed, in which a tip end of each pawl member 95 meshes with a tooth portion 94*a* of the ratchet wheel 94 to prevent reverse rotation (rotation in an upward winding direction) of the ratchet wheel 94 by means of this mesh. Meanwhile, each pawl member 95 is provided to be turnable, centering on a pawl shaft 95*a*, and is provided with an end of a biasing spring 95*b* which applies a biasing force thereto so that the tip end of the pawl member 95 may mesh with the tooth portion 94*a* of the ratchet wheel 94 at all times.

Also, the pawl members 95 are provided as a pair, and in the configuration illustrated in FIG. 14, one pawl member 95 is arranged at a position inclined at predetermined degrees such as 30 degrees to the vertical direction. Also, the other pawl member 95 is provided at a position adjacent to one pawl member 95, and an arrangement state thereof is one in which the pair of pawl members 95 fits in the same quadrant such as a first quadrant of a Cartesian coordinate system. Thus, a space S is formed at a position (position on the Z2 side and on a Y2 side in FIG. 14) corresponding to a third quadrant in the Cartesian coordinate system including the first quadrant, and the lower hook 45 can be situated in this space S in a case in which the load chain C1*a* is wound up. However, as for arrangement of the pair of pawl members 95, other arrangement may be adopted. For example, a configuration in which the pawl members 95 are arranged in a diagonal direction with a rotation center of the ratchet wheel 94 interposed therebetween may be adopted.

The wheel cover 14 is a member covering an upper side of the hand wheel 80 and an upper side of the brake mechanism 90 (refer to FIGS. 1 to 3 and the like) and is fixed on the second frame 12 via the stay bolts SB and the nuts N. This wheel cover 14 functions as a falling prevention portion. The wheel cover 14 is formed by means of plastic working such as press working and by means of plastic working, it includes a flange portion 141, a side surface portion 142, and an end surface portion 143 as illustrated in FIG. 15. The flange portion 141 is a part contacting the second frame 12. This flange portion 141 surface-contacts the second frame 12 and is thus provided in a state of favorably resisting fastening forces between the stay bolts SB and the nuts N. To achieve such surface contact, the flange portion 141 is formed to spread outward with respect to the side surface portion 142 toward a tip end side (X2 side) separating from the end surface portion 143 so as to be parallel to the second frame 12.

Meanwhile, the flange portion 141 is bent at an angle to be approximately perpendicular to the side surface portion 142, but in a state in which the wheel cover 14 is attached, the side surface portion 142 is not necessarily perpendicular to the second frame 12. Hence, the flange portion 141 may be bent at an angle to be perpendicular to the side surface portion 142 but does not always have to be bent perpendicularly.

Also, the wheel cover 14 illustrated in FIG. 15 and the like may be formed by deep-drawing a steel plate or the like.

The side surface portion 142 is a part connecting the flange portion 141 with an outer rim portion of the end surface portion 143 and is formed to have a large dimension in a direction of approaching to and separating from the second frame 12 (X direction) as illustrated in FIG. 1 and the like. Also, the side surface portion 142 is not provided over an entire circumference of the outer rim portion of the end surface portion 143. That is, the side surface portion 142 includes a part located on an upper side (hereinbelow referred to as an upper side surface portion 142*a* as needed) and a part located on a lower side (hereinbelow referred to as a lower side surface portion 142*b* as needed). On the upper side (Z1 side) of the wheel cover 14, two pairs each consisting of the stay bolt SB and the nut N are provided along the Y direction. Conversely, on the lower side (Z2 side) of the wheel cover 14, only one pair consisting of the stay bolt SB and the nut N is provided. Hence, the upper side surface portion 142*a* has a larger dimension in the Y direction than the lower side surface portion 142*b* and is provided with a pair of surrounding portions 148 (described below).

From a cut-out portion 144 between the upper side surface portion 142*a* and the lower side surface portion 142*b*, the hand chain C2 can be extended. Also, a right-left side surface portion 145 is provided at a part further on a side of the end surface portion 143 than the cut-out portion 144. The right-left side surface portion 145 is a part extending from the end surface portion 143 toward the second frame 12 in a similar manner to the upper side surface portion 142*a* and the lower side surface portion 142*b* and has a length toward the second frame 12 set to be significantly shorter than those of the upper side surface portion 142*a* and the lower side surface portion 142*b* due to the presence of the cut-out portion 144.

Also, the end surface portion 143 is a part of the wheel cover 14 opposed to the hand wheel 80. This end surface portion 143 is provided to be continuous with the upper side surface portion 142*a*, the lower side surface portion 142*b*, and the right-left side surface portion 145 at the outer rim portion thereof. The end surface portion 143 also has large dimensions in the Y direction and a Z direction (corresponding to a dropping direction) in FIG. 15. This end surface portion 143 may be formed in a flat shape but may employ a configuration having protrusions and recesses to improve design or improve strength of the wheel cover 14 as illustrated in FIG. 15. In a configuration illustrated in FIGS. 2, 3, and 15, the end surface portion 143 is provided with a protrusion 143*a* protruding toward the X1 side, and the protrusion 143*a* is formed approximately in a triangular shape in a planar view. Also, inside the protrusion 143*a*, a recess 143*b* recessed toward the X2 side is provided and is formed approximately in a triangular shape in a planar view.

Figure 3:
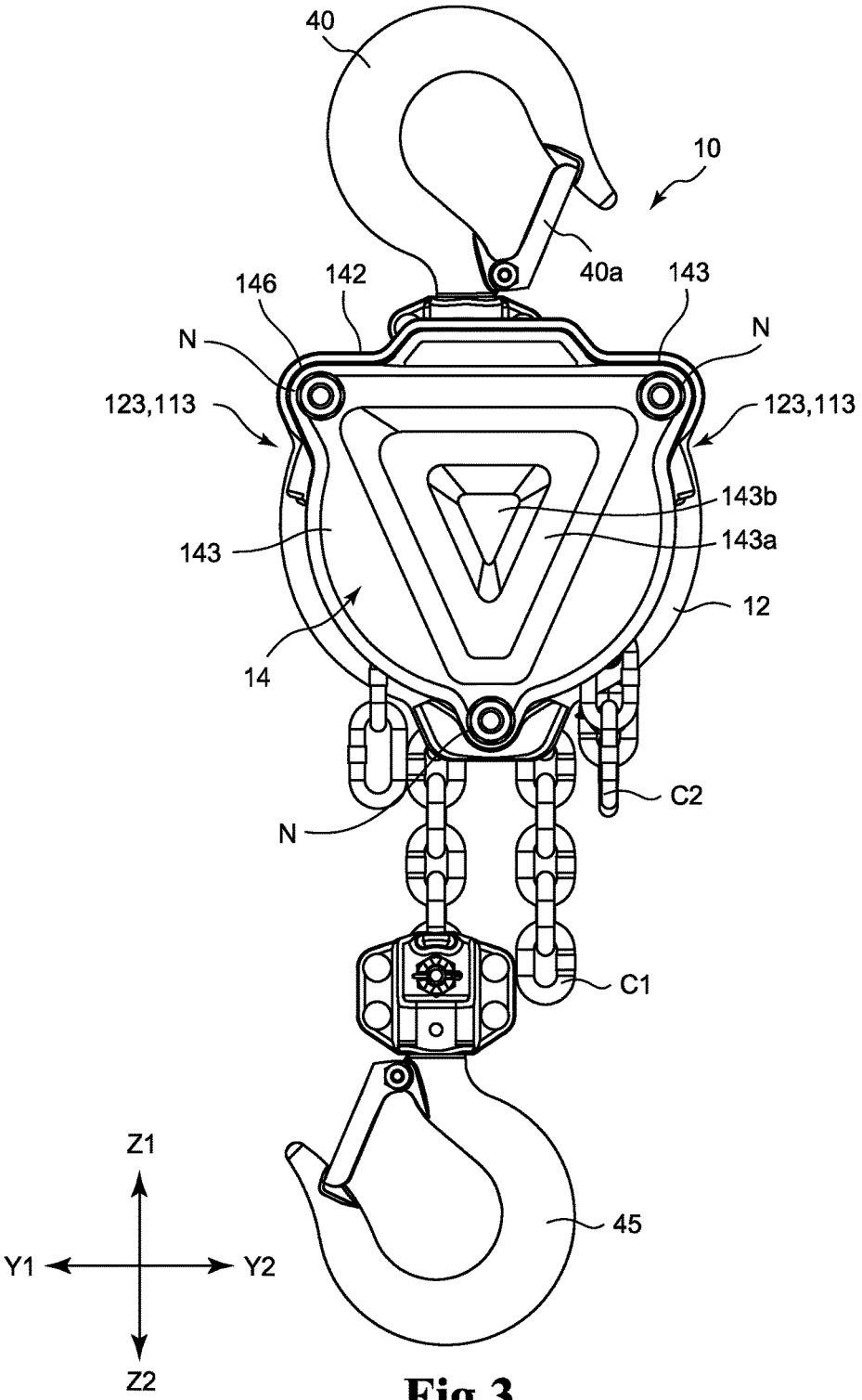
FIG. 3 is a rear view illustrating the appearance of the chain block in FIG. 1.

Also, as illustrated in FIGS. 3 and 15, in the present embodiment, the end surface portion 143 is provided so that a circular portion T1 formed in a circular shape having a radius from a center to an edge of R1 (in FIGS. 3 and 15, the circular part is in a partially circular shape whose upper part is cut out, but in the following description, such a partially circular shape shall be included in a circular shape) and a triangular portion T2 formed in a triangular shape having a distance from the same center to an edge of R2 may overlap with each other. Here, the radius R1 and the distance R2 have relation of R2>R1. Thus, corner sides of the triangular portion T2 are provided to project from the circular portion T1. Hereinbelow, each of these parts projecting from the circular portion T1 is referred to as a projection part 146.

In the present embodiment, the triangular portion T2 is provided to form an isosceles triangle in which a base is located on an upper side while a vertex is located on a lower side but may be provided to form an equilateral triangle or an approximately equilateral triangle. Also, the triangular portion may be provided to form a triangle other than the isosceles triangle.

Here, as is apparent from FIGS. 15 and 3, an outer rim portion of each surrounding portion 148 of the wheel cover 14 is provided at a similar position to an outer rim portion of the second frame 12. However, when the chain block 10 is dragged, the second frame 12 rather than the wheel cover 14 is preferably dragged. For this reason, around each of the frame projection portions 121, the outer rim portion of the frame projection portion 121 is provided to project further outward than the outer rim portion of the surrounding portion 148.

As illustrated in FIGS. 3 and 15, the projection part 146 is provided with a bolt hole 147 (corresponding to a fixing hole). Since each projection part 146 is provided with each bolt hole 147, in the present embodiment, the three bolt holes 147 are provided on an outer rim side of the wheel cover 14, and two of them are provided on the upper side (Z1 side) along the Y direction.

Figure 16:
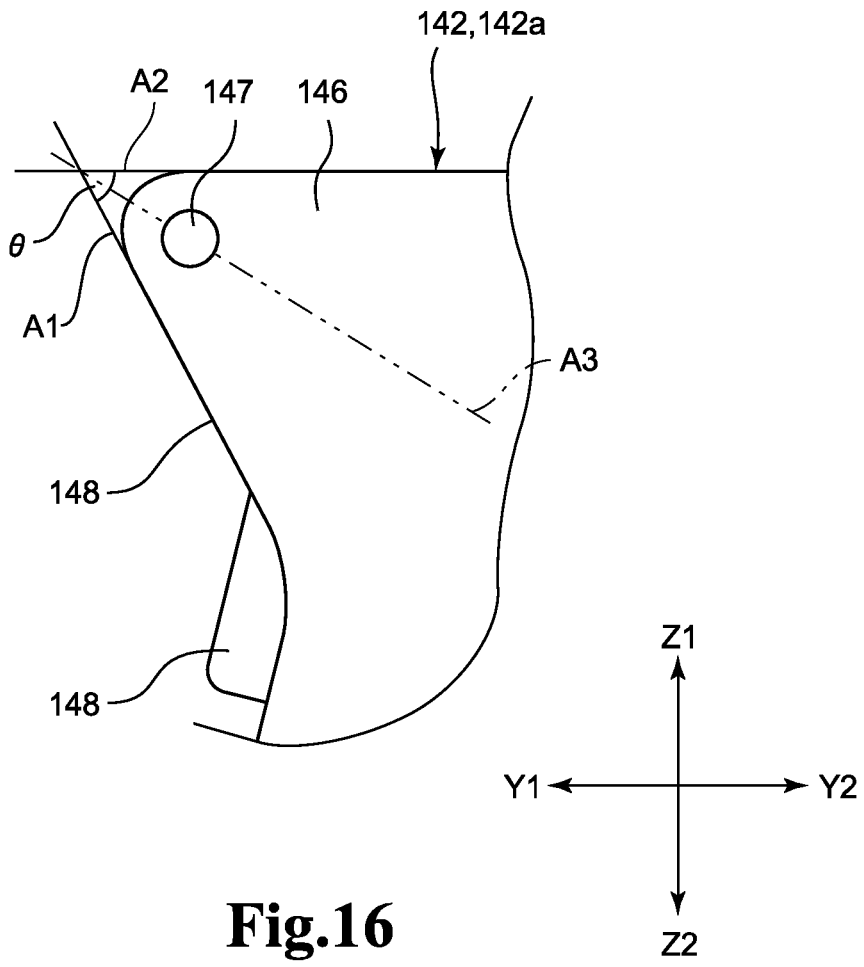
FIG. 16 is an enlarged partial plan view illustrating a shape around a projection part of an end surface portion in the wheel cover in FIG. 15.

As illustrated in FIGS. 3, 15, and 16, the upper side surface portion 142*a* is provided with the surrounding portions 148. An upper edge side (edge on the Z1 side) of each of the surrounding portions 148 is provided to be continuous with each of the projection parts 146. Also, each of the surrounding portions 148 is provided so that an angle □ between a tangent line A1 (may be a planar tangent plane A1) and a tangent line A2 (may be a planar tangent plane A2) in FIG. 16 may be an acute angle.

In a configuration illustrated in FIG. 16, the angle between the tangent line A1 (tangent plane A1) and the tangent line A2 (tangent plane A2) is set to approximately 60 degrees. Also, a line connecting an intersection point of the tangent line A1 (tangent plane A1) with the tangent line A2 (tangent plane A2) with a center is a bisector A3 of the angle between the tangent line A1 (tangent plane A1) and the tangent line A2 (tangent plane A2) or a line approximate to the bisector A3.

Figure 25:
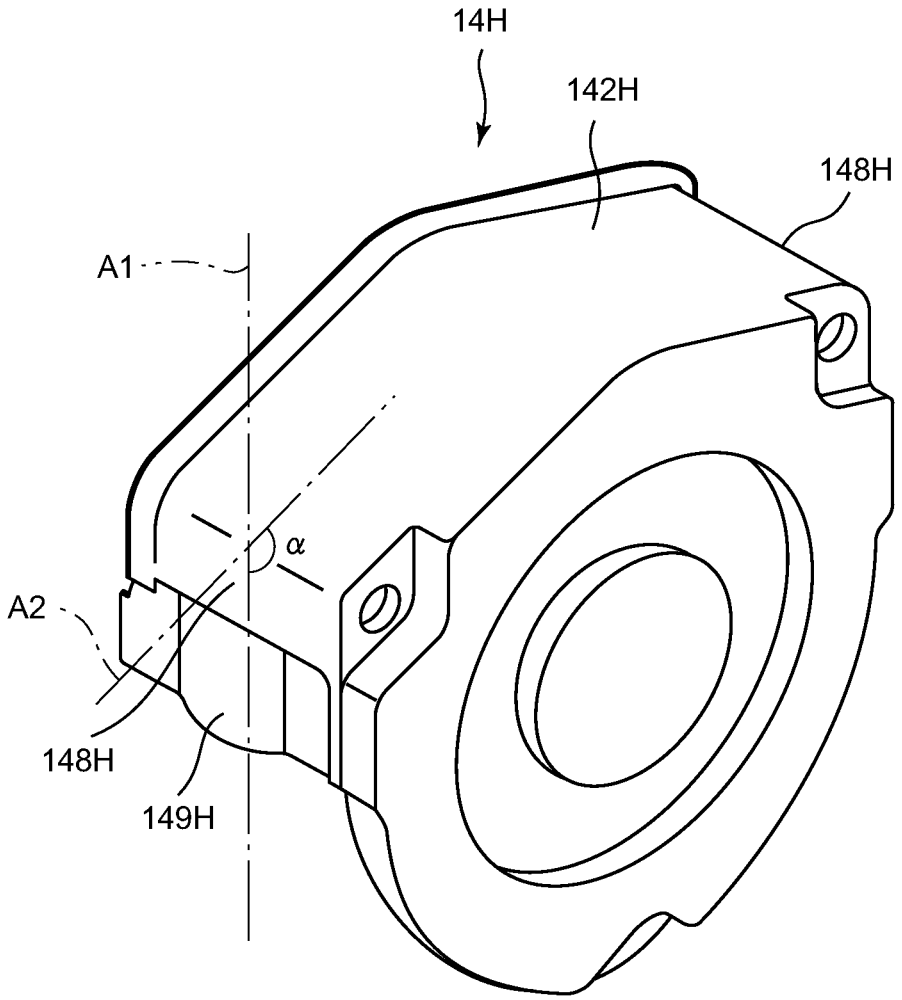
Fig.25 Prior Art
FIG. 25 is a perspective view illustrating a shape of the conventional wheel cover.

Here, in a conventional wheel cover 14H illustrated in FIGS. 17 and 25, an upper side surface portion 142H is provided so that an angle □ between a tangent line A1 (tangent plane A1) and a tangent line A2 (tangent plane A2) may be an obtuse angle. Thus, when the surrounding portion 148 of the wheel cover 14 according to the present embodiment and a part around an attaching position of the stud bolt SB in the conventional wheel cover 14H (a part corresponding to the surrounding portion 148; hereinbelow referred to as a corner portion 148H) are compared, the wheel cover 14 according to the present embodiment has a characteristic of higher strength.

To be specific in this respect, in a conventional configuration illustrated in FIG. 25, the corner portion 148H is provided to be further away from the stay bolt SB and the bolt hole 147 than the surrounding portion 148 according to the present embodiment as illustrated in FIGS. 15 and 16. Hence, the end surface portion 143 around the bolt hole 147 is easier to deform than in the case in which the surrounding portion 148 according to the present embodiment presents when a load acts. Conversely, in the present embodiment, the surrounding portion 148 is located further on an inner side of the end surface portion 143 than in the conventional configuration illustrated in FIG. 25 and is provided to be close to the stud bolt SB and the bolt hole 147. Thus, even when a load acts on the end surface portion 143 around the bolt hole 147, the end surface portion 143 and the surrounding portion 148 are difficult to deform.

Figure 17A:
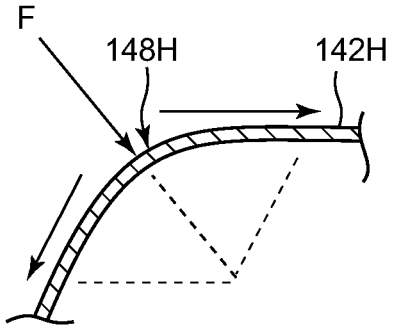
Fig.17A Prior Art
FIGS. 17(A) and 17(B) illustrate states in which a force acts on a side surface portion of the wheel cover.
Figure 17B:
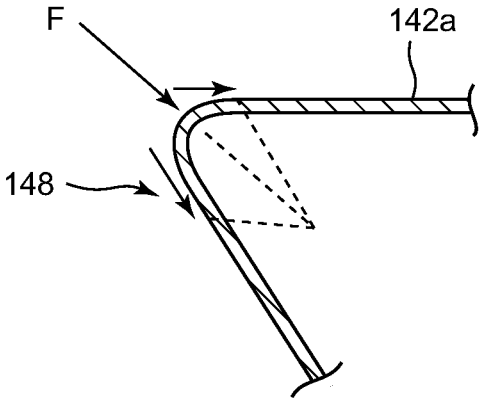

Here, states in which an external force acts on the surrounding portion 148 and the end surface portion 143 are illustrated in FIGS. 17(A) and 17(B). Consider a case in which force F heading for the rotation center acts on the part in the conventional configuration corresponding to the surrounding portion 148 as illustrated in FIG. 17(A) and a case in which the force F heading for the rotation center similarly acts on the surrounding portion 148 according to the present embodiment as illustrated in FIG. 17(B). As is apparent from FIGS. 17(A) and 17(B), a component force along the upper side surface portion 142*a* is larger in the conventional configuration. Accordingly, in the case in which the surrounding portion 148 according to the present embodiment presents, the strength is higher than in the conventional configuration as illustrated in FIGS. 17(A) and 25.

Also, as illustrated in FIGS. 2 and 15, the surrounding portion 148 is provided to be continuous with a chain guide portion 149. The chain guide portion 149 is a part provided to be close to the hand chain C2 and a part adapted to hold the hand chain C2 to prevent the hand chain C2 from coming off of the chain pocket 82 even when the hand chain C2 moves significantly (so to speak, even when the hand chain C2 is deflected). This chain guide portion 149 is provided to be located further on the lower side (Z2 side) than the surrounding portion 148 and includes a guide curved portion 149*a*, a leg portion 149*b*, and a tip end projection portion 149*c*. The guide curved portion 149*a* is a part opposed to the chain pocket 82 of the hand wheel 80. End portions of this guide curved portion 149*a* along the X direction are provided to be opposed to the flange portions 80*a*, respectively.

Meanwhile, a space between the end portion of the guide curved portion 149*a* and the flange portion 80*a* is preferably smaller than a diameter of the metal ring C2*a* of the hand chain C2. In the case of such a configuration, the hand chain C2 is prevented from coming off of the chain pocket 82 even when the hand chain C2 moves significantly (even when the hand chain C2 is deflected).

Also, the leg portion 149*b* has an end portion thereof on the X2 side provided at a similar position of the flange portion 141 to enable a surface of the end portion thereof to contact the second frame 12. Also, the surface of the end portion of the leg portion 149*b* is provided with the tip end projection portion 149*c*. The tip end projection portion 149*c* is a part to be inserted in an insertion hole 124 (refer to FIG. 14) provided in the second frame 12. The tip end projection portion 149*c* is inserted in the insertion hole 124 to enable strength of the chain guide portion 149 to be improved.

Figure 18:
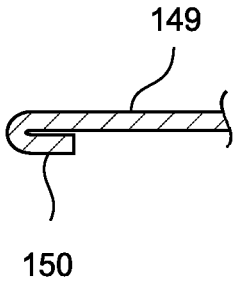
FIG. 18 is a partial cross-sectional view illustrating a configuration around a folded portion of a chain guide portion in the wheel cover in FIG. 15.

Here, as illustrated in FIG. 18, an outer edge portion on the lower side of the chain guide portion 149 is provided with a folded portion 150 by means of hemming. The folded portion 150 is provided over the entirety of the guide curved portion 149*a* and the leg portion 149*b*. Providing the folded portion 150 enables strength of the chain guide portion 149 to be improved. Providing the folded portion 150 also enables safety to be enhanced when a body part such as a hand contacts the folded part 150. However, the folded portion 150 does not need to be provided over the entirety of the guide curved portion 149*a* and the leg portion 149*b* and may employ a configuration in which the folded portion 150 does not exist at least in a part of it.

(About Configuration for Preventing Falling when Chain Block 10 is Dragged)

Next, in the chain block 10 configured as above, a configuration for preventing falling when the chain block 10 is dragged will be described.

First, in the configuration for preventing falling, the aforementioned frame projection portions 111 and 121 are provided. Providing these frame projection portions 111 and 121 prevents the first frame 11 and the second frame 12 from rolling along the circumferential directions and enables velocity generated by rolling of the chain block 10 to be decreased.

Figure 19A:
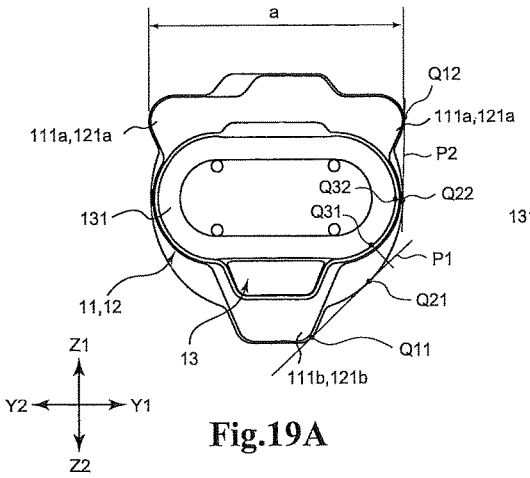
FIG. 19(A) is a front view illustrating a dimension in a Y direction on a side of a gear case of the chain block in FIG. 1.
Figure 19B:
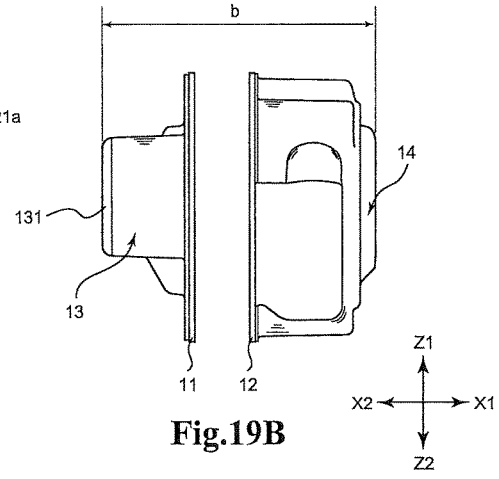
FIG. 19(B) is a side view illustrating a dimension in an X direction of the chain block in FIG. 1.

Also, as illustrated in FIGS. 19(A) and 19(B), the chain block 10 is configured so that a dimension a of the chain block 10 in the Y direction and a dimension b thereof in the X direction may have the following relation.

$$b \geq a \qquad \text{(Equation 1)}$$

In the chain block 10, the dimension a is a length between end portions of the outer rim portions in the Y direction of the first frame 11 and the second frame 12. Also, the dimension b is a length between end portions in the X direction of the chain block 10. In this case, the dimension b is a dimension from an edge portion on the X1 side of the protrusion 143*a* to an edge portion on the X1 side of the gear case 13. However, the dimension b may be a dimension from a flat part of the end surface portion 143, not the edge portion on the X1 side of the protrusion 143*a*, to an edge portion on the X1 side of the gear case 13 or may be a dimension with reference to other parts (such as an internal wall surface on the X1 side of the wheel cover 14 and an internal wall surface on the X2 side of the gear case 13).

Also, the chain block 10 is configured so that a weight W1 of the side of the gear case 13 and a weight W2 of the side of the wheel cover 14 may have the following relation.

$$W2 \geq W1 \qquad \text{(Equation 2)}$$

Meanwhile, in relation to (Equation 2), the side of the gear case 13 and the side of the wheel cover 14 may have relation in which moment acting on the side of the wheel cover 14 is larger than moment acting on the side of the gear case 13. Also, any part that is attached to the first frame 11 and whose weight is added to the weight W1 of the side of the gear case 13 corresponds to a gear case side structure while any part that is attached to the second frame 12 and whose weight is added to the weight W2 of the side of the wheel cover 14 corresponds to a wheel cover side structure.

Also, a height of the gear storage portion 131 is configured in the following manner. That is, when the chain block 10 is inclined with the side of the gear storage portion 131 facing down and is dragged as it is, the chain block 10 may fall and contact the ground in a state in which the name plate 132 is opposed to the ground.

Figure 20A:
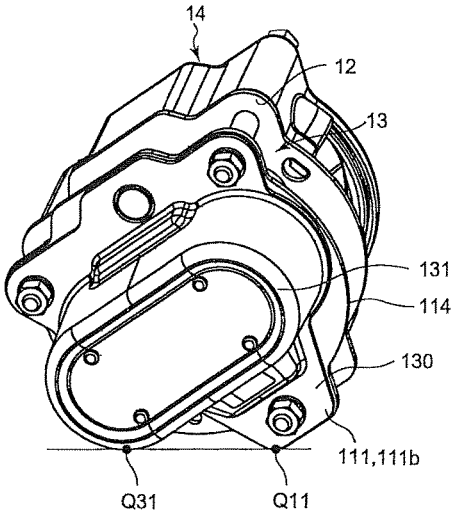
FIGS. 20(A) and 20(B) are perspective views illustrating a state in which the chain block in FIG. 1 is inclined to the side of the gear case.
Figure 20B:
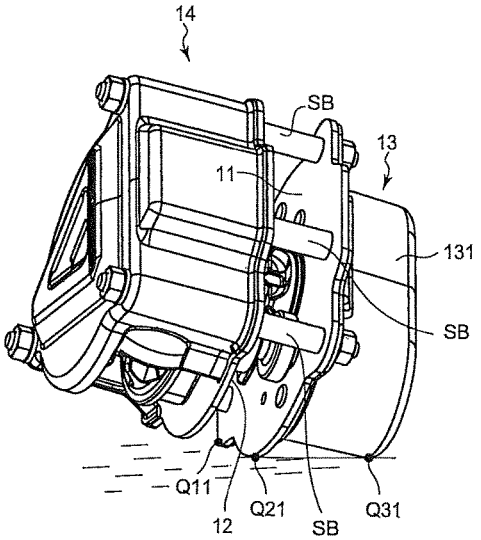

Here, the chain block 10 is most likely to fall in a case illustrated in FIGS. 20(A) and 20(B). The reason for this will be described based on FIGS. 19(A) and 19(B). A part on the side of the frame projection portion 111*b* that will contact the ground is referred to as a contact part Q11, a part of the outer rim portion of the first frame 11 that will contact the ground with the recess 113*b* interposed between the contact part Q11 and this part is referred to as a contact part Q21, and a straight line connecting the contact part Q11 with the contact part Q21 is referred to as a straight line P1. In this case, a contact part Q31 on the side of the gear storage portion 131 that will contact the ground at the same time as the contact parts Q11 and Q21 resides on a straight line perpendicular to the straight line P1.

Similarly, a part on the side of the frame projection portion 111*a* that will contact the ground is referred to as a contact part Q12, a part of the outer rim portion of the first frame 11 that will contact the ground with the recess 113*a* interposed between the contact part Q12 and this part is referred to as a contact part Q22, and a straight line connecting the contact part Q12 with the contact part Q22 is referred to as a straight line P2. In this case, a contact part Q32 on the side of the gear storage portion 131 that will contact the ground at the same time as the contact parts Q12 and Q22 resides on a straight line perpendicular to the straight line P2. Here, as is apparent from FIG. 19(A), a distance K1 between the straight line P1 and the contact part Q31 is longer than a distance K2 between the straight line P2 and the contact part Q32. Hence, in the case of the inclination illustrated in FIGS. 20(A) and 20(B) (that is, the case in which three points of the contact parts Q11, Q21, and Q31 contact the ground), an inclination angle □ of the chain block 10 is the largest, and the chain block 10 is most likely to fall.

Hereinbelow, the inclination of the chain block 10 in the case in which the contact parts Q11, Q21, and Q31 contact the ground is considered. In this case, to prevent the chain block 10 from being further inclined, a height S of the gear storage portion 131 has only to be sufficiently long. That is, the longer the height S of the gear storage portion 131 is, the smaller the inclination angle □ of the chain block 10 becomes. Accordingly, the height S of the gear storage portion 131 may be set in a direction in which a ceiling surface (surface to which the name plate 132 is attached) of the gear storage portion 31 will contact the ground as long as to prevent the chain block 10 from further rolling. Meanwhile, the height S may be a height at the contact part Q31 that will contact the ground from the first frame 11 to the gear storage portion 131.

Figure 21:
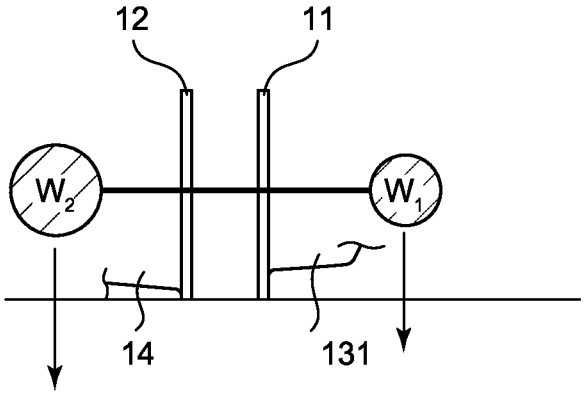
FIG. 21 illustrates a weight balance in the chain block in FIG. 1.

Here, as illustrated in FIG. 21, in the chain block 10, the side of the gear case 13 and the side of the wheel cover 14 are arranged so that the weight W1 of the side of the gear case 13 and the weight W2 of the side of the wheel cover 14 may be balanced with the first frame 11 and the second frame 12 interposed therebetween. Hence, even when the chain block 10 is inclined with the gear storage portion 131 facing down, the chain block 10 easily returns from the inclined posture to the standing posture due to the action of the weight W2 of the side of the wheel cover 14. Also, even when the chain block 10 is inclined with the gear storage portion 131 facing down, the gear storage portion 131 functions as a falling prevention portion, the contact part Q31 contacts the ground, and further falling is prevented.

A case in which the chain block 10 is inclined with the gear storage portion 131 facing down in a state in which the frame projection portion 111*a* abuts on the ground to prevent rolling is considered. As described above, the distance K1 between the straight line P1 and the contact part Q31 is longer than the distance K2 between the straight line P2 and the contact part Q32 (refer to FIG. 19(A)). Thus, the chain block 10 is more difficult to fall in the state in which the frame projection portion 111*a* abuts on the ground to prevent rolling than in a state in which the frame projection portion 111*b* abuts on the ground to prevent rolling.

Similarly, the chain block 10 is more difficult to fall when the chain block 10 is inclined with the wheel cover 14 facing down in a state in which the frame projection portion 121*a* or the frame projection portion 121*b* abuts on the ground to prevent rolling than in the state in which the frame projection portion 111*b* abuts on the ground to prevent rolling.

Figure 22:
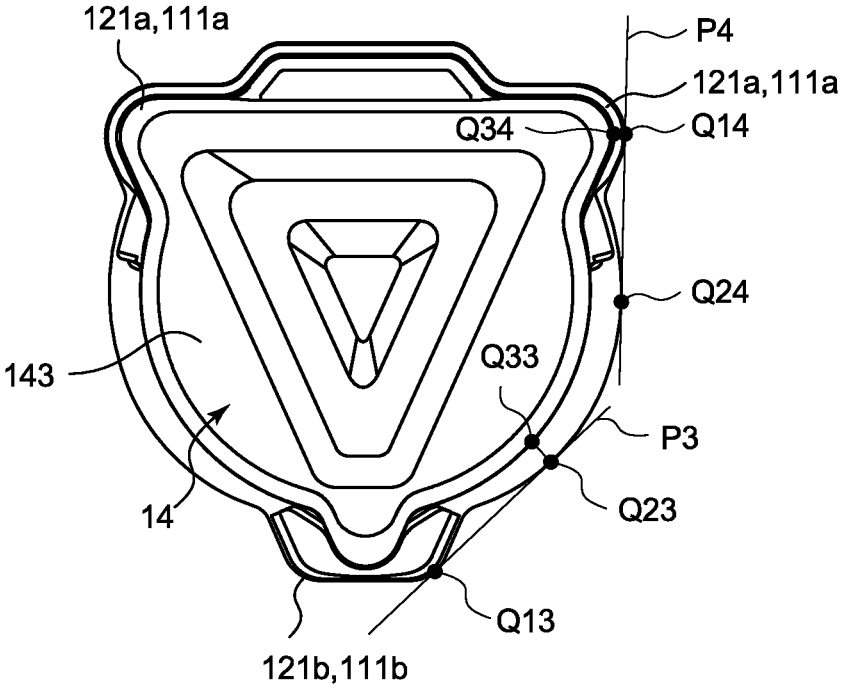
FIG. 22 is a front view illustrating contact parts on a side of the wheel cover in the chain block in FIG. 1.

This respect will be described. As illustrated in FIG. 22, a part on the side of the frame projection portion 121*b* that will contact the ground is referred to as a contact part Q13, a part of the outer rim portion of the second frame 12 that will contact the ground with the recess 123*b* interposed between the contact part Q13 and this part is referred to as a contact part Q23, and a straight line connecting the contact part Q13 with the contact part Q23 is referred to as a straight line P3. In this case, a contact part Q33 on the side of the wheel cover 14 that will contact the ground at the same time as the contact parts Q13 and Q23 resides on a straight line perpendicular to the straight line P3. However, a distance K3 between the straight line P3 and the contact part Q33 is shorter than the aforementioned distance K1.

Moreover, as is apparent from FIG. 2 and the like, a distance K5 (height) from the second frame 12 to the end surface portion 143 of the wheel cover 14 is equal to or longer than a distance K6 (height) from the first frame 11 to the ceiling surface of the gear storage portion 131. Accordingly, the chain block 10 is more difficult to fall when the chain block 10 is inclined with the side of the wheel cover 14 facing down in the state in which the frame projection portion 121*b* abuts on the ground to prevent rolling than in the state in which the frame projection portion 111*b* abuts on the ground to prevent rolling.

Similarly, a part on the side of the frame projection portion 121*a* that will contact the ground is referred to as a contact part Q14, a part of the outer rim portion of the second frame 12 that will contact the ground with the recess 123*a* interposed between the contact part Q14 and this part is referred to as a contact part Q24, and a straight line connecting the contact part Q14 with the contact part Q24 is referred to as a straight line P4. In this case, a contact part Q34 on the side of the wheel cover 14 that will contact the ground at the same time as the contact parts Q14 and Q24 resides on a straight line perpendicular to the straight line P4. However, a distance K4 between the straight line P4 and the contact part Q34 is shorter than the aforementioned distance K1. Moreover, as described above, the distance K5 is equal to or longer than the distance K6. Accordingly, the chain block 10 is more difficult to fall when the chain block 10 is inclined with the side of the wheel cover 14 facing down in the state in which the frame projection portion 121*a* abuts on the ground to prevent rolling than in the state in which the frame projection portion 111*b* abuts on the ground to prevent rolling.

Meanwhile, the contact parts Q11 to Q14 are configured to contact the ground at the same time as the contact parts Q21 to Q24 at positions spaced as much as predetermined rolling prevention distances from the contact parts Q21 to Q24. Accordingly, the contact parts Q11 to Q14 function as rolling restriction portions.

<About Action of Chain Block>

(1) About Action when Load is Raised or Lowered with Use of Chain Block 10

Action when a load is raised or lowered with use of the chain block 10 configured as above will be described below. In a case of raising a load with use of the aforementioned chain block 10, when the hand chain C2 is operated in the upward winding direction in a state in which the load is hung on the lower hook 45, the hand wheel 80 is rotated. At this time, due to mesh of the female screw portion 81 with the male screw portion 76 of the drive shaft 70, the hand wheel 80 travels in a direction (direction toward the X2 in FIGS. 3 and 4) of pressing the brake plate 92 (92*b*) and strongly presses the brake plate 92 (92*b*). Thereafter, the hand wheel 80 and the drive shaft 70 are rotated integrally, and a driving force caused by this rotation is transmitted via the pinion gear 72, the large-diameter gear 61, and the small-diameter gear 62 to the load gear 31 to cause the load sheave hollow shaft 20 to be rotated. Accordingly, the load chain C1 is wound up, and the load is hoisted.

Conversely, in a case in which the load being hoisted is lowered, the hand chain C2 is fed in a reverse direction of a direction when the load is hoisted. This causes the hand wheel 80 to loosen the press toward the brake plate 92*b*. The drive shaft 70 is rotated in a reverse direction of the upward winding direction of the load as much as the loosened amount. Thus, the load is gradually lowered.

Meanwhile, in a stop state of the ratchet wheel 94, the tip end of each pawl member 95 meshes with the tooth portion 94*a* of the ratchet wheel 94. Also, even when one takes one's hand off the hand chain C2 at the time of upward winding and tries to reversely rotate the drive shaft 70 by means of gravity of the load, the brake plate 92*b* is pressed to the ratchet wheel 94 by the hand wheel 80, and the brake plate 92*a* is pressed to the flange portion 91*b* of the brake receiver 91 by the ratchet wheel 94 in a state in which the hand wheel 80 is not rotated. Thus, a brake force against the gravity of the load is applied, and the load is prevented from being lowered.

(2) About Operations when Chain Block 10 is Dragged

Next, operations when the aforementioned chain block 10 is dragged will be described below. In a case in which a user drags the chain block 10 in a state of gripping the load chain C1, the chain block 10 is dragged in the standing posture in which the first frame 11 and the second frame 12 contact the ground, in a posture in which the ceiling surface of the gear case 13 faces down, or in a posture in which the protrusion 143*a* of the wheel cover 14 faces down.

Here, in the case in which the chain block 10 is dragged in the falling posture in which the ceiling surface of the gear case 13 faces down, an action point of a force to the chain block 10 by the load chain C1 is located further on an upper side than the protrusion 143*a*. In addition, the weight W2 of the side of the wheel cover 14 resides further on the upper side than the protrusion 143*a*. Hence, the weight W2 resides in a higher position than the center of the entire chain block 10 (between the first frame 11 and the second frame 12), which brings about an unbalanced state. Accordingly, as the chain block 10 is dragged, the chain block 10 eventually gets in the standing posture.

Also, in the case in which the chain block 10 is dragged in the falling posture in which the wheel cover 14 faces down, the action point of the force to the chain block 10 by the load chain C1 is located on the upper side, and the weight W1 of the side of the gear case 13 resides further on the upper side. Hence, the weight W1 resides in a higher position than the center of the entire chain block 10, which brings about an unbalanced state. Accordingly, as the chain block 10 is dragged, the chain block 10 eventually gets in the standing posture.

According to the aforementioned (Equation 1), the dimension b of the chain block 10 in the X direction is equal to or longer than the dimension a of the chain block 10 in the Y direction. In this case, the chain block 10 is configured so that a position of a weighted center may be lower in the standing posture than in the falling posture in which the ceiling surface of the gear case 13 faces down and in the falling posture in which the wheel cover 14 faces down. Also, in the standing posture, no weight body (such as the weight W1 and the weight W2) exists in a higher position than the weighted center in the standing posture, in contrast with the case of the falling posture in which the ceiling surface of the gear case 13 faces down and the case of the falling posture in which the wheel cover 14 faces down. Accordingly, when the chain block 10 is dragged in the standing posture, the posture is stable.

Here, in the case in which the chain block 10 is dragged in the standing posture, the behavior thereof is as follows. First, when the chain block 10 is dragged in the standing posture, the chain block 10 rolls on the ground along the arc shapes of the outer rim portions of the first frame 11 and the second frame 12. However, after slight rolling, any of the frame projection portions 111*a*, 111*b*, 121*a*, and 121*b* abuts on the ground. This prevents further rolling of the chain block 10.

Here, even when the chain block 10 is further inclined with the gear storage portion 131 facing down in the state in which the frame projection portions 111*b* and 121*b* abut on the ground, the gear storage portion 131 contacts the ground at the contact part Q31, and further inclination of the chain block 10 is prevented. Also, as illustrated in FIG. 21, the chain block 10 easily returns from the inclined posture to the standing posture due to the action of the weight W2 of the side of the wheel cover 14. Accordingly, even when the chain block 10 is inclined to the side of the gear case 13, the chain block 10 returns to the standing posture due to the action of the weight W2 of the side of the wheel cover 14.

Even in the case in which the chain block 10 is inclined in the reverse direction, that is, even when the chain block 10 is inclined with the wheel cover 14 facing down in the state in which the frame projection portion 121*b* abuts on the ground, the wheel cover 14 contacts the ground at the contact part Q33, and further inclination of the chain block 10 is prevented. Also, as illustrated in FIG. 21, the chain block 10 easily returns from the inclined posture to the standing posture due to the action of the weight W1 of the side of the gear case 13. Accordingly, even when the chain block 10 is inclined to the side of the wheel cover 14, the chain block 10 returns to the standing posture due to the action of the weight W1 of the side of the gear case 13.

The chain block 10 repeats inclination either to the side of the gear case 13 or to the side of the wheel cover 14 and return to the standing posture, keeping the state in which the frame projection portions 111*b* and 121*b* abut on the ground, and is dragged while being inclined slightly to the right or to the left.

Also, when the chain block 10 is further inclined with the gear storage portion 131 facing down in the state in which the frame projection portions 111*a* and 121*a* abut on the ground, or when the chain block 10 is further inclined with the wheel cover 14 facing down in the state in which the frame projection portions 111*a* and 121*a* abut on the ground, the behavior thereof is similar to those in the above cases. That is, the chain block 10 repeats inclination either to the side of the gear case 13 or to the side of the wheel cover 14 and return to the standing posture, keeping the state in which the frame projection portions 111*a* and 121*a* abut on the ground, and is dragged while being inclined slightly to the right or to the left.

<About Effect>

According to the chain block 10 configured as above, it is possible to keep the state in which the side surfaces (outer rim portions) of the first frame 11 and the second frame 12 are dragged.

That is, the first frame 11 and the second frame 12 are provided with the frame projection portions 111*a*, 111*b*, 121*a*, and 121*b* serving as the rolling restriction portions which restrict rolling of the first frame 11 and the second frame 12 along the outer rims when the chain block 10 is in the standing posture. For this reason, even when the chain block 10 is dragged, any of the frame projection portions 111*a*, 111*b*, 121*a*, and 121*b* contacts the ground to prevent further rolling of the chain block 10. Accordingly, it is possible to prevent the chain block 10 from falling with the gear case 13 facing down or with the wheel cover 14 facing down due to a case in which the chain block rolls relatively long to cause an increase of velocity or the like as in the conventional chain block, and the chain block 10 can be dragged with the standing posture kept.

Thus, it is possible to prevent heads of the rivets 133 attaching the name plate 132 from being damaged and the rivets 133 from coming off as in the case in which the chain block 10 is dragged with the gear case 13 facing down. Accordingly, it is possible to prevent dust and the like from going into the rivet holes of the gear case 13 and prevent the dust and the like from having an effect on mesh of the various gears.

Also, it is possible to prevent the tip end sides of the stay bolts SB and the nuts N from being damaged, prevent the nuts N and the stay bolts SB from coming off, and prevent the wheel cover 14 from coming off as in the case in which the chain block 10 is dragged with the wheel cover 14 facing down.

Also, in the present embodiment, two points, one from the contact parts Q11 to Q14 and the other from the contact parts Q21 to Q24, contact the ground at the same time in a state of being spaced as much as the predetermined rolling prevention distance. Accordingly, it is possible to prevent rolling of the chain block 10 along the outer rim portion to enable the chain block 10 to be dragged.

Further, in the present embodiment, the weight W2 of the wheel cover side structure is larger than the weight W1 of the gear case side structure. Thus, even when the chain block 10 is inclined with the gear case 13 facing down, the chain block 10 can return to the standing posture due to the action of the weight W2 of the wheel cover side structure. Accordingly, it is possible to prevent the rivets 133 attaching to the gear case 13 from coming off further favorably.

Still further, in the present embodiment, the height of the gear storage portion 131 is set, when the chain block 10 is inclined with the side of the gear storage portion 131 facing down in the state in which rolling of the first frame 11 and the second frame 12 is restricted by the frame projection portions 111*a*, 111*b*, 121*a*, and 121*b*, to prevent the chain block 10 from being inclined further and prevent the chain block 10 from falling with the gear storage portion 131 facing down. Thus, it is possible to prevent the heads of the rivets 133 attaching the name plate 132 from being damaged and the rivets 133 from coming off as in the case in which the chain block 10 is dragged with the gear case 13 facing down. Accordingly, it is possible to prevent dust and the like from going into the rivet holes of the gear case 13 and prevent the dust and the like from having an effect on mesh of the various gears.

Still further, in the present embodiment, the height of the wheel cover 14 is set, when the chain block 10 is inclined with the side of the wheel cover 14 facing down in the state in which rolling of the first frame 11 and the second frame 12 is restricted by the frame projection portions 111*a*, 111*b*, 121*a*, and 121*b*, to prevent the chain block 10 from being inclined further and prevent the chain block 10 from falling with the wheel cover 14 facing down. Thus, it is possible to prevent the tip end sides of the stay bolts SB and the nuts N from being damaged, prevent the nuts N and the stay bolts SB from coming off, and prevent the wheel cover 14 from coming off as in the case in which the chain block 10 is dragged with the wheel cover 14 facing down.

Still further, in the present embodiment, the first frame 11 is provided with the circular portion 110 having the arc-like outer rim portion and the frame projection portions 111*a* and 111*b* projecting to the outer circumferential side from the circular portion 110 and serving as the rolling restriction portions. By providing the frame projection portions 111*a* and 111*b* projecting from the circular portion 110 in this manner, the frame projection portions 111*a* and 111*b* can prevent rolling of the chain block 10 favorably as the rolling restriction portions.

Still further, in the present embodiment, in a planar view of the first frame 11, the first frame 11 is provided with the stretching portion 114 whose projecting amount with respect to the outer rim portion of the gear case 13 is larger than those of the sides of the frame projection portions 111*a* and 111*b*. Providing such a stretching portion 114 enables a dragged part to be away from an overlapping surface of the first frame 11 and the gear case 13 even in a case in which the chain block 10 is dragged. Here, when the overlapping surface is damaged, a problem in which dust goes into the gear case 13 will occur. However, since providing the aforementioned stretching portion 114 causes the overlapping surface to be away from the dragged part, it is possible to prevent dust from going into the gear case 13.

Still further, in the present embodiment, the second frame 12 is attached to the wheel cover 14 in a state of projecting further to the outer circumferential side than the wheel cover 14. In addition, the second frame 12 also includes the circular portion 120 and the frame projection portions 121*a* and 121*b*. Thus, providing the frame projection portions 111*a* and 111*b* can prevent rolling of the chain block 10 favorably. In addition, it is possible to make a dragged part away from an overlapping surface of the second frame 12 and the wheel cover 14 even in a case in which the chain block 10 is dragged. Since this causes the overlapping surface to be away from the dragged part, it is possible to prevent dust from going into the wheel cover 14.

Still further, in the present embodiment, the position of the weighted center of the chain block 10 in the standing posture resides in a lower position than the weighted center in the falling posture with the wheel cover 14 facing down and the weighted center in the falling posture with the gear case 13 facing down. Thus, in a case in which the chain block 10 is dragged in the standing posture, the posture can be stabilized. Conversely, when the chain block 10 is dragged in the falling posture with the wheel cover 14 facing down or in the falling posture with the gear case 13 facing down, the chain block 10 is unbalanced and thus easily returns to the standing posture.

Modification Examples

Although the embodiments of the present invention have been described above, the present invention can be altered in various manners. Examples thereof will be described below.

In the above embodiment, the first frame 11 is provided with the frame projection portions 111*a* and 111*b* while the second frame 12 is provided with the frame projection portions 121*a* and 121*b*, and these frame projection portions function as the rolling restriction portions. However, the configuration of each of the rolling restriction portions is not limited to this configuration. For example, the outer rim portion of each of the first frame 11 and the second frame 12 may be provided to be linear to prevent rolling, and the linear outer rim portion may serve as the rolling restriction portion. Also, the outer rim portion of the first frame 11 may contact the ground at any points as long as at least two points in the outer rim portion of the first frame 11 contact the ground at positions spaced as much as a predetermined rolling prevention distance. Similarly, the outer rim portion of the second frame 12 may contact the ground at any points as long as at least two points in the outer rim portion of the second frame 12 contact the ground at positions spaced as much as a predetermined rolling prevention distance.

Meanwhile, as in the case in which the outer rim portion of each of the first frame 11 and the second frame 12 is provided to be linear, the outer rim portion of each of the first frame 11 and the second frame 12 may not be provided with the recesses 113 or 123.

Also, the rolling restriction portion may be configured by attaching a separate member to each of the first frame 11 and the second frame 12. Similarly, the falling prevention portion may be configured by attaching a separate member to each of the first frame 11 and the second frame 12.

Figure 23:
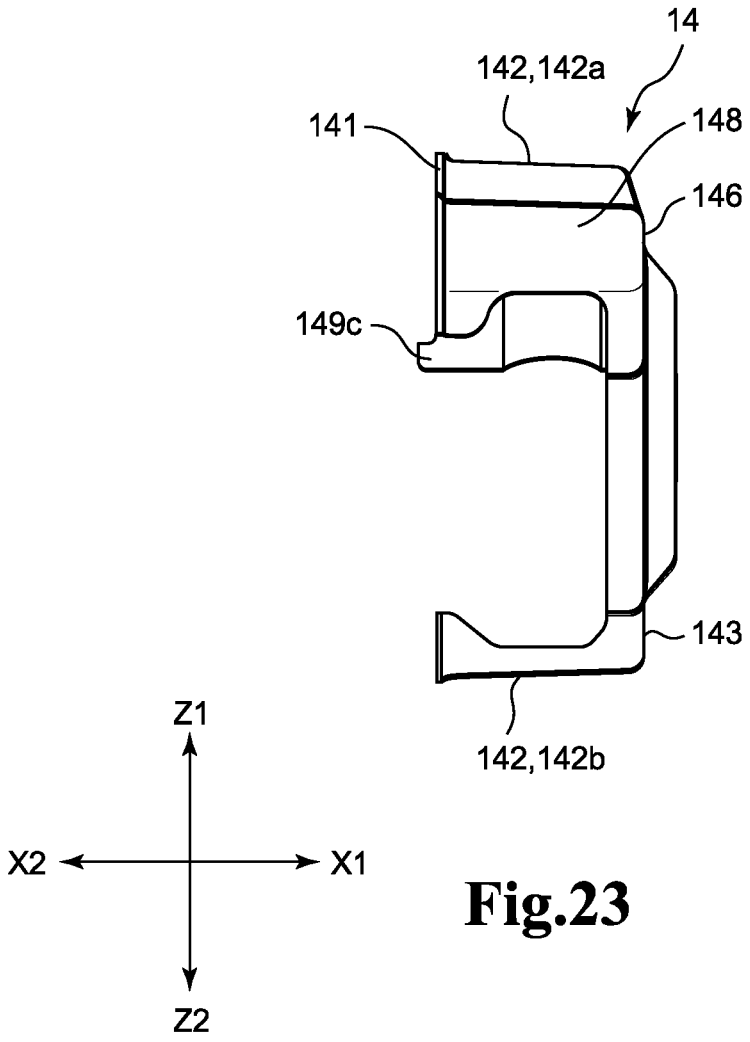
FIG. 23 is a side view illustrating a shape of the wheel cover according to a modification example of the present embodiment.
Figure 24:
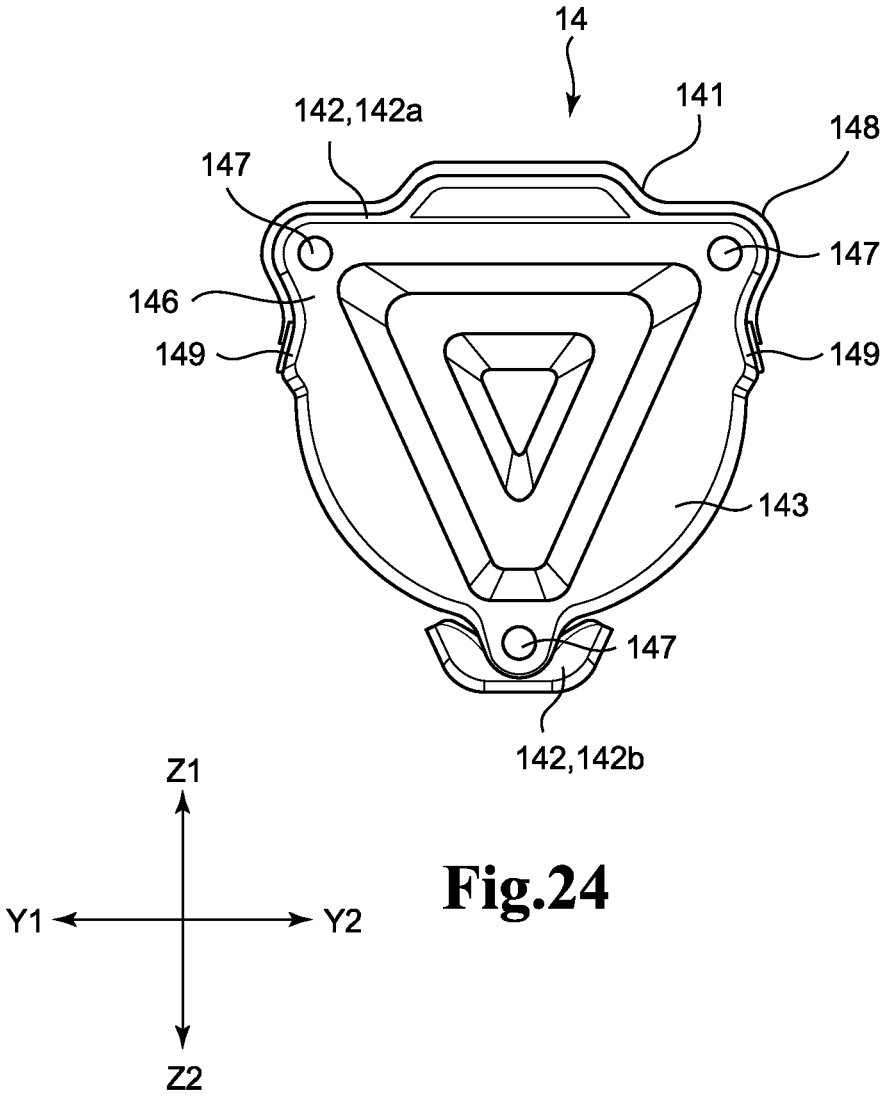
FIG. 24 is a plan view illustrating the shape of the wheel cover according to the modification example of the present embodiment.

Also, in the above embodiment, the chain guide portion 149 is provided integrally in a state of being continuous with the surrounding portion 148. However, as illustrated in FIGS. 23 and 24, the chain guide portion 149 may employ a configuration in which the chain guide portion 149 is provided separately without being continuous with the surrounding portion 148. That is, by attaching the chain guide portion 149 to the end surface portion 143 by means of welding or the like, the chain guide portion 149 may be provided separately from the surrounding portion 148.

In such a configuration, flexibility of an arranging position of the chain guide portion 149 to the end surface portion 143 can be improved. Also, even in this configuration, the surrounding portion 148 still exists in the side surface portion 142, and providing the surrounding portion 148 can thus improve strength of the wheel cover 14.

In such a configuration, flexibility of an arranging position of the chain guide portion 149 to the end surface portion 143 can be improved. Also, even in this configuration, the surrounding portion 148 still exists in the side surface portion 142, and providing the surrounding portion 148 can thus improve strength of the wheel cover 14.

In the above embodiment, the configuration in which the auxiliary plate 50 is fixed on the first frame 11 by means of the fixing holes 53 and the fixing tools 55 is described. However, instead of the combination of the fixing holes 53 and the fixing tools 55, at least one combination of a boss hole and a boss may be used, or the auxiliary plate 50 may be fixed on the first frame 11 by means of welding or the like.

REFERENCE SIGNS LIST

10 . . . Chain block
11 . . . First frame
12 . . . Second frame (corresponding to frame member)
13 . . . Gear case (corresponding to falling prevention portion)
14 . . . Wheel cover (corresponding to falling prevention portion)
20 . . . Load sheave hollow shaft (corresponding to load sheave member)
23 . . . Load sheave
30 . . . Speed reducing mechanism
31 . . . Load gear (corresponding to part of gear member)
31*b*, 31*b*1, 31*b*2 . . . Recess
40 . . . Upper hook
42 . . . Guide roller
45 . . . Lower hook
60 . . . Speed reducing gear member (corresponding to part of gear member)
61 . . . Large-diameter gear
61*a* . . . Chamfered portion
62 . . . Small-diameter gear
70 . . . Drive shaft
72 . . . Pinion gear (corresponding to part of gear member)
73 . . . Inclined portion
74 . . . Curved portion
80 . . . Hand wheel
90 . . . Brake mechanism
91 . . . Brake receiver
92 . . . Brake plate
94 . . . Ratchet wheel
95 . . . Pawl member
110, 120 . . . Circular portion
111, 111*a*, 111*b*, 121, 121*a*, 121*b* . . . Frame projection portion (corresponding to rolling restriction portion)
112, 122 . . . Insertion hole
113, 113*a*, 113*b*, 123, 123*a*, 123*b* . . . Recess
114 . . . Stretching portion
124 . . . Insertion hole
130 . . . Attaching plate portion
131 . . . Gear storage portion
132 . . . Name plate
133 . . . Rivet
141 . . . Flange portion
142 . . . Side surface portion
142*a* . . . Upper side surface portion
142*b* . . . Lower side surface portion
143 . . . End surface portion
143*a* . . . Protrusion
143*b* . . . Recess
148 . . . Surrounding portion
149 . . . Chain guide portion
149*a* . . . Guide curved portion
149*b* . . . Leg portion
149*c* . . . Tip end projection portion
150 . . . Folded portion
B1 to B5 . . . Bearing
C1, C2 . . . Load chain
N . . . Nut
S . . . Space
SB . . . Stay bolt (corresponding to fastening tool)
Q11 to 14, 21 to 24, 31 to 34 . . . Contact part

The invention claimed is:

1. A chain block comprising:

a first frame rotatably supporting a load sheave member around which a load chain is wound and rotatably supporting a drive shaft which is rotated separately from the load sheave member;

a second frame arranged to be opposed to the first frame and cooperating with the first frame to rotatably support the load sheave member and rotatably support the drive shaft;

a wheel cover side structure including a hand wheel around which a hand chain is wound and a wheel cover which covers the hand wheel and residing on an opposite side of the first frame in a direction away from the second frame;

a gear case side structure including a plurality of gear members adapted to transmit a rotation force from the hand wheel via the drive shaft to the load sheave member and a gear case covering the plurality of gear members and residing on an opposite side of the second frame in a direction away from the first frame, and an upper hook attached to the first frame and the second frame;

wherein a weight of the wheel cover side structure is larger than a weight of the gear case side structure, the first frame and the second frame comprises a circular portion having an arc-shaped outer rim portion and a frame projection portion acutely projecting to an outer circumferential side from the circular portion such that a recess is formed at an intersection of the circular portion and the frame projection portion, the frame projection portion being proximate to the upper hook, the frame projecting portion comprises a rolling restriction portion structured to maintain a posture of the dragged chain block in a standing posture or an inclined posture by restricting rolling along outer circumferences of the first frame and the second frame in a case of the standing posture in which the first frame and the second frame contact an installation part or in a case of the inclined posture in which the first frame or the second frame contacts the installation part, and the recess is structured to maintain a distance between the circular portion and the frame projection portion.

2. The chain block according to claim 1, wherein the first frame is attached with the gear case in a state of projecting further to an outer circumferential side than the gear case.

3. The chain block according to claim 1, wherein the second frame is attached with the wheel cover in a state of projecting further to an outer circumferential side than the wheel cover.

4. The chain block according to claim 1, wherein the rolling restriction portion is configured to contact the installation part at a position spaced as much as a predetermined rolling prevention distance from the outer rim portion of each of the first frame and the second frame.

5. The chain block according to claim 4, wherein the dragged chain block is maintained in the standing posture or the inclined posture while the chain block is dragged with three contact parts contacting with the installation part, when the chain block is installed on the installation part, a first contact part of the frame projection portion contacting with the installation part, a second contact part of the circular portion contacting with the installation part, and a third contact part of the gear storage portion or a fourth contact part of the wheel cover contact with the installation part so that the dragged chain block is restricted from rolling along outer circumferences of the first frame and the second frame, a first inclination angle θ of the chain block when the inclination angle is largest is defined in a state where the third contact part of the gear storage portion contacts with the installation part, the first contact part of the frame projection portion of the first frame contacts with the installation part, and the second contact part of the circular portion contacts with the installation part, a second inclination angle θ of the chain block is defined in a state where a fourth contact part of the wheel cover contacts with the installation part, a fifth contact part of a frame projection portion of the second frame contacts with the installation part, and a sixth contact part of the circular portion contacts with the installation part, the first inclination angle is larger than the second inclination angle.

6. The chain block according to claim 1, wherein the gear case includes a gear storage portion in which the gear members are stored, a height of the gear storage portion is set, when the chain block is inclined with a side of the gear storage portion facing down in a state in which rolling of each of the first frame and the second frame is restricted by the rolling restriction portion, to prevent the chain block from being inclined further and prevent the chain block from falling with the gear storage portion facing down, and the gear storage portion contacts the installation part to cause the gear case to function as a falling prevention portion.

7. The chain block according to claim 1, wherein a height of the wheel cover is set, when the chain block is inclined with a side of the wheel cover facing down in a state in which rolling of each of the first frame and the second frame is restricted by the rolling restriction portion, to prevent the chain block from being inclined further and prevent the chain block from falling with the wheel cover facing down, and the wheel cover contacts the installation part to cause the wheel cover to function as a falling prevention portion.

8. The chain block according to claim 7, wherein in a planar view of the first frame, the first frame is provided with a stretching portion whose projecting amount of the outer rim portion of the first frame with respect to an outer rim portion of the gear case is larger than that of a side of the frame projection portion, the stretching portions enables a dragged part to be away from the gear storage portion even in a case in which the chain block is dragged.

9. The chain block according to claim 1, wherein a position of a weighted center in the standing posture resides in a lower position than a weighted center in a falling posture with the wheel cover facing down and a weighted center in a falling posture with the gear case facing down.

* * * * *